US012611044B2

(12) United States Patent
Scarleski

(10) Patent No.: US 12,611,044 B2
(45) Date of Patent: Apr. 28, 2026

(54) ACTIVE MATTRESS SPINNER

(71) Applicant: Levitation Sciences LLC, St. Petersburg, FL (US)

(72) Inventor: William J. Scarleski, St. Petersburg, FL (US)

(73) Assignee: Levitation Sciences LLC, St. Petersburg, FL (US)

( * ) Notice: Subject to any disclaimer, the term of this patent is extended or adjusted under 35 U.S.C. 154(b) by 587 days.

(21) Appl. No.: 17/637,628

(22) PCT Filed: Aug. 31, 2020

(86) PCT No.: PCT/US2020/048797
§ 371 (c)(1),
(2) Date: Feb. 23, 2022

(87) PCT Pub. No.: WO2021/042053
PCT Pub. Date: Mar. 4, 2021

(65) Prior Publication Data

US 2022/0273111 A1 Sep. 1, 2022

Related U.S. Application Data

(60) Provisional application No. 62/893,511, filed on Aug. 29, 2019.

(51) Int. Cl.
*A47C 21/06* (2006.01)
*A47C 21/04* (2006.01)

(52) U.S. Cl.
CPC ..... *A47C 21/06* (2013.01); *A47C 21/042* (2013.01)

(58) Field of Classification Search
CPC ..... A47C 21/042; A47C 21/04; A47C 21/028; A47C 21/06; A47C 7/1028; A47C 27/08;
(Continued)

(56) References Cited

U.S. PATENT DOCUMENTS 954,284 A * 4/1910 Hecht ..... A47C 27/081 5/422
3,845,795 A 11/1974 Andreasson
(Continued)

FOREIGN PATENT DOCUMENTS

GB 2503912 A * 1/2014 ..... A47C 27/08

OTHER PUBLICATIONS

PCT/US2020/048797 International Search Report and Written Opinion of the International Searching Authority dated Dec. 3, 2020 (13 pages).

*Primary Examiner* — Justin C Mikowski
*Assistant Examiner* — Amanda L Bailey
(74) *Attorney, Agent, or Firm* — Amundsen Davis, LLC

(57) ABSTRACT

A system is provided for facilitating the lifting and rotation of a mattress with respect to a box spring or platform. The system includes a first and second layer of material attached in a manner to form an expandable air volume. The expandable air volume may be disposed between an underside of the mattress and a top side of the box spring or platform. The system may also include one or more holes and one or more adjustable openings in the first or second layers. The system may also include an air inlet nozzle in fluid communication with the expandable air volume. The expandable air volume may lift the mattress with respect to the box spring or platform under the influence of an external air supply in fluid communication with the air inlet nozzle such that the mattress may be rotated with respect to the box spring or platform.

20 Claims, 21 Drawing Sheets

(58) Field of Classification Search
CPC ... A47C 27/081; A47C 27/082; A47C 27/086; A47G 9/00; A47G 9/003; A47G 9/02; A47G 9/0292; F04D 29/08
See application file for complete search history.

(56) References Cited

U.S. PATENT DOCUMENTS

| | | | | |
|---|---|---|---|---|
| 4,068,334 | A | 1/1978 | Randall | |
| 6,418,579 | B2 | 7/2002 | Perez et al. | |
| 2002/0148045 | A1* | 10/2002 | Giori | A47C 27/15 5/709 |
| 2003/0051292 | A1* | 3/2003 | Ferrand | A61G 7/00 5/600 |
| 2005/0198740 | A1* | 9/2005 | Bichler | A47C 27/081 5/655.3 |
| 2013/0269108 | A1* | 10/2013 | Scarleski | A47C 21/00 5/488 |
| 2014/0026318 | A1 | 1/2014 | Bethel et al. | |
| 2015/0040326 | A1* | 2/2015 | Fairburn | A61G 7/05792 5/713 |
| 2017/0363374 | A1* | 12/2017 | McGregor | A61F 7/02 |

* cited by examiner

ACTIVE MATTRESS SPINNER

BACKGROUND

1. Field of the Invention

The present disclosure relates to a system for facilitating the lifting and rotation of a mattress with respect to a box spring or lower mattress or platform and more particularly to a system which allows lifting and rotation of a mattress with minimal effort in order to relocate worn or depressed portions of the mattress in order to even out the overall wear of the mattress.

2. Description of the Prior Art

A conventional bed includes a box spring or bottom mattress or platform and an mattress. For example, a mattress may be supported by a box spring which is normally supported by a bed frame. In such examples, the mattress ends up being suspended about 13-16 inches from the floor. In other examples, the mattress may be placed on top of a platform forming a platform bed. In both examples, the mattress is held in place by friction and its weight.

Various types of mattresses are known. For example, U.S. Pat. Nos. 7,617,556 and 7,644,671 disclose conventional mattresses. Such conventional mattresses include a "casing" which is formed from material for holding the internal components of the mattress. The casing includes a bottom panel and four (4) vertical panels connected to the periphery of the bottom panel forming an open top container. In one such conventional mattress, a spring core is disposed in the container and rests against the bottom floor and fits snugly against the vertical panels. One or more layers of foam padding is placed on top of the spring core and covered with a top cover which is secured to the vertical panels.

In other conventional mattresses, a foam core is used in place of the spring core. Other conventional mattresses may have a so-called "pillow-top". The pillow top is generally formed as a comforter secured to the top cover and filled with cotton or some type of fibrous material.

A problem with the above various types of mattresses is that over time the mattress materials lose their resiliency as people use them, thus causing body depressions to develop in the mattress. In order to even out the wear in the mattress, a conventional practice is to rotate the mattress in the horizontal plane to relocate the body depressions so they do not continue to grow. Depending on the size of the mattress, one or two people may be required to rotate the mattress. For example, king and queen size mattresses may likely require two people to rotate the mattress, while full and twin size mattresses may be rotated by a single person, though may still require two people.

Mattresses are relatively heavy items. The weight of a mattress varies as a function of the coil core, the gauge of the coil and the type of foam material used. An average king size mattress weighs between 85 and 115 pounds. High end king size mattresses with latex or memory foam can weigh as much as 300 pounds (http://www.mattressdirectonline.com).

In order to rotate a mattress, the mattress must first be lifted and then rotated. Accordingly, rotating a mattress is difficult work. Depending on the weight of the mattress, rotating a mattress can be virtually impossible for some people, such as senior citizens, as well as people that are handicapped or disabled and others.

In order to address this problem, mattresses with removable pillow tops have been developed. An example of such a mattress is disclosed in U.S. Pat. No. 5,414,882, which provides a mattress with a pillow top that is secured to the top cover of the mattress by way of a zipper. With such a configuration, the pillow top can be relatively easily rotated by unzipping the pillow top, rotating it and zipping the pillow top back in place. While such a configuration enables body depressions in the pillow top to be relocated, it has no effect on body depressions that result in the mattress itself.

Further, people often desire to tuck sheets or blankets under the foot of a mattress to keep the sheets or blankets in place. Doing so requires lifting the foot of the mattress up in order to place the sheets or blankets underneath and then lowering the mattress. As mentioned, however, mattresses are relatively heavy items, thus making lifting even just the foot of the mattress difficult or even virtually impossible for some people. Accordingly, there is a need for a system to facilitate the lifting and rotation of a mattress.

SUMMARY

The present disclosure relates to a system for facilitating the lifting and rotation of a mattress supported by a box spring or a platform. In particular, the presently disclosed system, in conjunction with an external air supply, facilitates a mattress lifting with respect to its box spring or platform on an air cushion, which reduces the friction between the mattress and its box spring or platform and enables a person to rotate the mattress with minimal preventative force. Slick surfaces between the mattress and box spring or platform helps reduce the friction even further. The system, by lifting the mattress on an air cushion, makes the mattress virtually weightless with respect to a person and accordingly enables a person to also tuck sheets and/or blankets underneath the foot of a mattress without having to lift the foot of the mattress.

In one aspect of the present disclosure, a system for facilitating lifting and rotation of a mattress with respect to a box spring or platform is provided. The system may include a first layer of material, a second layer of material, one or more holes disposed in one or the first layer or the second layer, one or more adjustable openings disposed in one of the first layer or the second layer, and an air inlet nozzle. The second layer of material may be attached to the first layer of material in a manner to form an expandable air volume that is flat in a normal mode of operation and expanded in an expanded mode of operation. The expandable air volume may be disposed between an underside of the mattress and a top side of the box spring or platform. The one or more holes may continuously releasing air from within the expandable air volume. The one or more adjustable openings may control the flow of air within the expandable air volume. The air inlet nozzle may be in fluid communication with the expandable air volume, and may include an interior portion disposed at least partially within the expandable air volume and an exterior portion such that the exterior portion couples to the interior portion with at least a portion of the first or the second layer disposed between the interior and exterior portions. The one or more holes, the one or more adjustable openings, and the air inlet nozzle are configured to regulate the air within the expandable air volume under the influence of an external air supply in fluid communication with the air inlet nozzle. The expandable air volume lifts the mattress with respect to the box spring or platform and enables the mattress to be rotated with respect to the box spring or platform.

In another aspect of the present disclosure, a system for facilitating lifting of two mattresses with respect to their respective box springs or platforms is provided. The system includes a first subsystem and a second subsystem. The first subsystem may include a first layer of material, a second layer of material, one or more first holes disposed in one or the first layer or the second layer, one or more first adjustable openings disposed in one of the first layer or the second layer, and a first air inlet nozzle. The second layer of material may be attached to the first layer of material in a manner to form a first expandable air volume that is flat in a normal mode of operation and expanded in an expanded mode of operation. The first expandable air volume may be disposed between an underside of a first mattress and a top side of a first box spring or platform. The one or more first holes may continuously releasing air from within the first expandable air volume. The one or more first adjustable openings may control the flow of air within the first expandable air volume. The first air inlet nozzle may be in fluid communication with the first expandable air volume, and may include a first interior portion disposed at least partially within the first expandable air volume and a first exterior portion such that the first exterior portion couples to the first interior portion with at least a portion of the first or the second layer disposed between the first interior and first exterior portions. The one or more first holes, the one or more first adjustable openings, and the first air inlet nozzle are configured to regulate the air within the first expandable air volume under the influence of an external air supply in fluid communication with the first air inlet nozzle. The first expandable air volume lifts the first mattress with respect to the first box spring or platform and enables the first mattress to be rotated with respect to the first box spring or platform.

The second subsystem may include a third layer of material, a fourth layer of material, one or more second holes disposed in one or the third layer or the fourth layer, one or more second adjustable openings disposed in one of the third layer or the fourth layer, and a second air inlet nozzle. The third layer of material may be attached to the fourth layer of material in a manner to form a second expandable air volume that is flat in a normal mode of operation and expanded in an expanded mode of operation. The second expandable air volume may be disposed between an underside of a second mattress and a top side of a second box spring or platform. The one or more second holes may continuously releasing air from within the second expandable air volume. The one or more second adjustable openings may control the flow of air within the second expandable air volume. The second air inlet nozzle may be in fluid communication with the second expandable air volume, and may include a second interior portion disposed at least partially within the second expandable air volume and a second exterior portion such that the second exterior portion couples to the second interior portion with at least a portion of the first or the second layer disposed between the second interior and second exterior portions. The one or more second holes, the one or more second adjustable openings, and the second air inlet nozzle are configured to regulate the air within the second expandable air volume under the influence of an external air supply in fluid communication with the second air inlet nozzle. The second expandable air volume lifts the second mattress with respect to the second box spring or platform and enables the second mattress to be rotated with respect to the second box spring or platform. The first air inlet nozzle is in fluid communication with the second air inlet nozzle. The present disclosure relates to a system for facilitating the lifting and rotation of a mattress supported by a box spring or a platform. The system includes a first layer of material. The system further includes a second layer of material attached to the first layer of material to form an expandable air volume that is flat in a normal mode of operation and expanded in an expanded mode of operation, the expandable air volume to be disposed between an underside of the mattress and a top side of the box spring or platform. The system further includes one or more holes disposed in one of the first layer or the second layer for or formed therebetween by the first layer and the second layer continuously releasing air from within the expandable air volume, wherein one or more of the holes is an adjustable opening disposed in one of the first layer or the second layer for controlling flow of air within the expandable air volume. The system includes an air inlet nozzle in fluid communication with the expandable air volume, wherein the air inlet nozzle includes an interior portion disposed at least partially within the expandable air volume and an exterior portion such that the exterior portion couples to the interior portion with at least a portion of the first or at least a portion of the first layer or the second layer disposed between the interior and exterior portions, wherein the one or more holes, the adjustable opening, and the air inlet nozzle are configured to regulate the air within the expandable air volume under influence of an external air supply in fluid communication with the air inlet nozzle, and wherein the expandable air volume lifts the mattress with respect to the box spring or platform.

DETAILED DESCRIPTION

Figure 1:
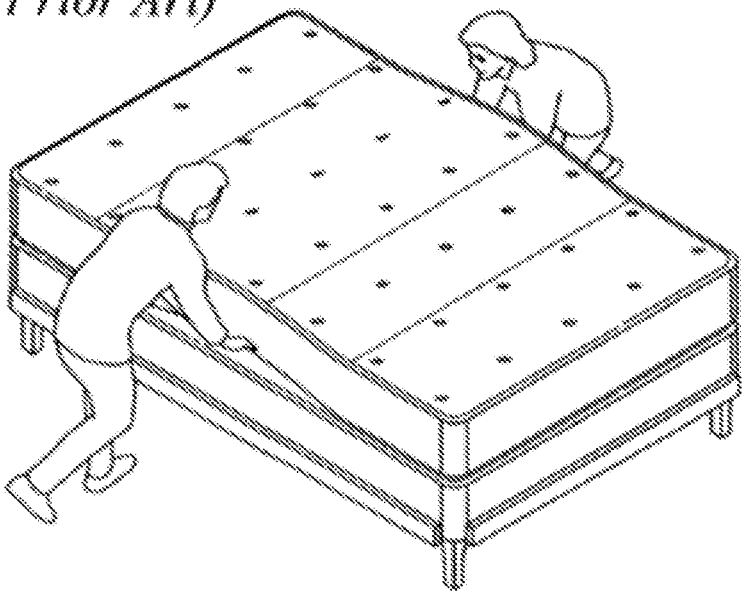
Fig. 1 (Prior Art)
FIG. 1 illustrates a schematic of people lifting a conventional mattress to rotate it.
Figure 2:
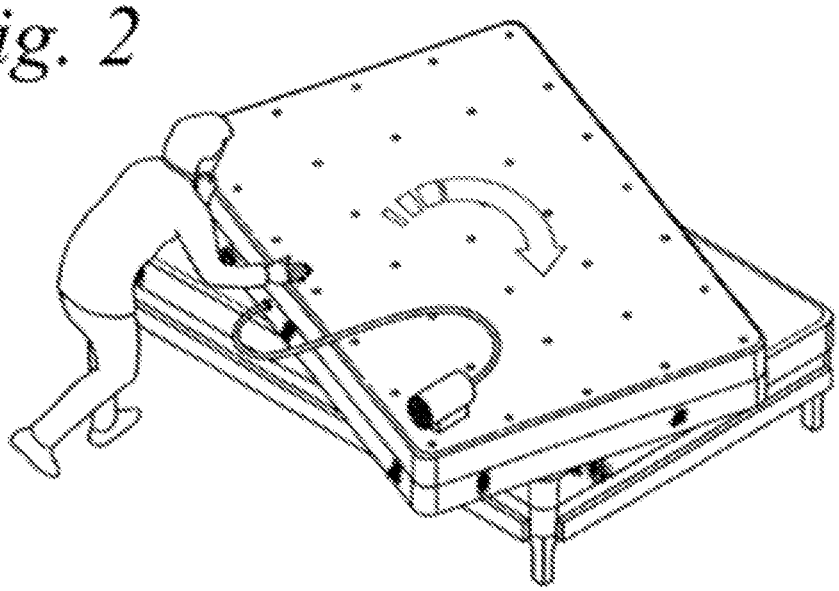
FIG. 2 illustrates a schematic of a person rotating a mattress with the presently disclosed system's assistance, according to an example of the present disclosure.

The present disclosure relates to a system for facilitating the lifting and rotation (e.g., in a horizontal plane) of a mattress supported by a box spring or a platform. Conventionally, rotating a mattress requires one or two people to lift and rotate the mattress, as illustrated in FIG. 1. The presently disclosed system, on the other hand, enables one person to rotate a mattress with minimal effort, and without lifting the mattress, as illustrated in FIG. 2. In particular, the presently disclosed system, in conjunction with an external air supply, facilitates a mattress lifting with respect to its box spring or platform on an air cushion, which reduces the friction between the mattress and its box spring or platform and enables a person to rotate the mattress with minimal preventative force. Slick surfaces between the mattress and box spring or platform help to reduce the friction even further. The system, by lifting the mattress on an air cushion created by constant air flow, also makes the mattress virtually weightless with respect to a person and accordingly enables a person to also tuck sheets and/or blankets underneath the foot of a mattress without having to lift the foot of the mattress. The air cushion holds the tucked sheets and/or blankets in place against the mattress until the external air supply is turned off and the mattress lowers on top of the tucked in sheets and/or blankets.

Figure 3:
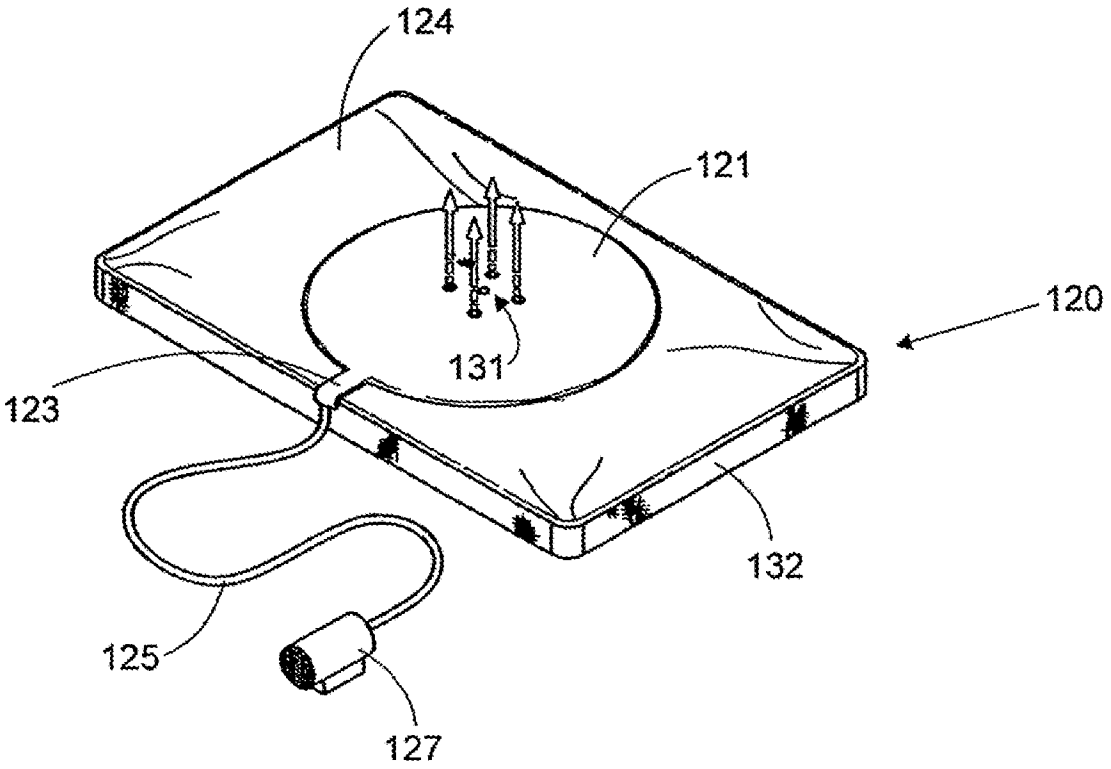
FIG. 3 illustrates a schematic of an example levitation system, according to an example of the present disclosure.

FIG. 3 illustrates an example levitation system 120 of the present disclosure that may be disposed underneath a mattress and above a box spring or platform. The levitation system 120 includes a first layer of material 124 and a second layer of material 121. The first layer of material 124 is sized according to the corresponding mattress with which it will be used (e.g., king, queen, twin, etc.). The first layer of material 124 and the second layer of material 121 are attached (e.g., sewing or other suitable means) in a manner to form an expandable air volume between the first and second layers of material 124 and 121. In some examples, the second layer of material 121 may be attached to the first layer of material 124 such that the expandable air volume only covers a portion of the first layer of material 124, as illustrated in FIG. 3. In other instances, the expandable air volume may be any shape beyond the circular shape illustrated in FIG. 3. In some examples, the second layer of material 121 may be attached to the first layer of material 124 such that the expandable air volume covers the full extent of the first layer of material 124.

The levitation system 120 also may include an air inlet nozzle 123 that is in fluid communication with the expandable air volume. For example, an external air supply such as air pump 127 may deliver air through a tube 125 that fits around the air inlet nozzle 123 to deliver the air into the expandable air volume. The air inlet nozzle 123 may be disposed in any suitable position on either the first layer of material 124 or the second layer of material 121 such that it is in fluid communication with the expandable air volume. For example, as illustrated in FIG. 3, the air inlet nozzle 123 may be disposed on the side of the levitation system 120. In other examples, the air inlet nozzle 123 may be disposed in another location on the same side, on the opposite side, or on the head or foot sides of the system 120.

Figure 4A:
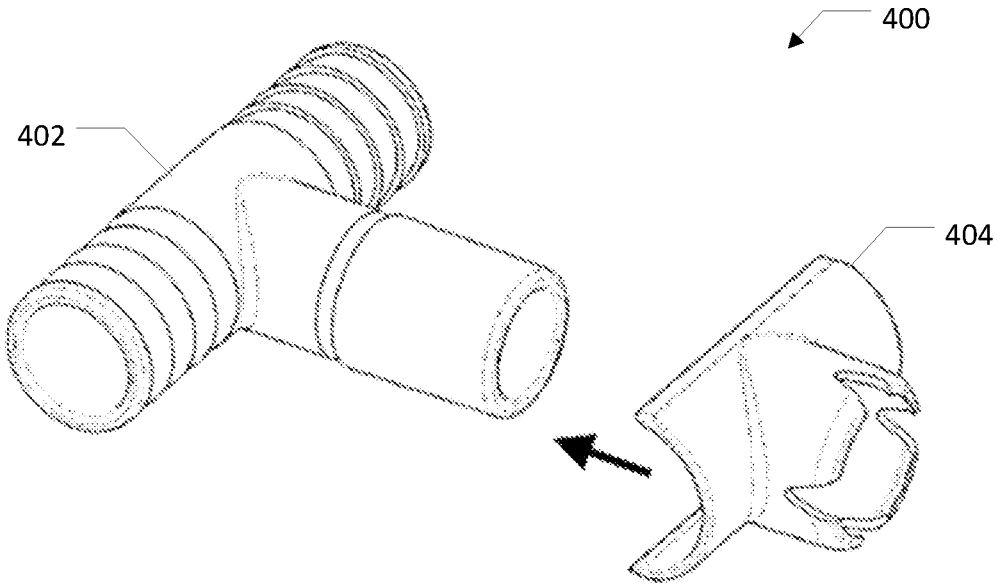
FIGS. 4A and 4B illustrate schematics of an example T-shaped air inlet nozzle without barbs on the inlet end, according to an example of the present disclosure.
Figure 4B:
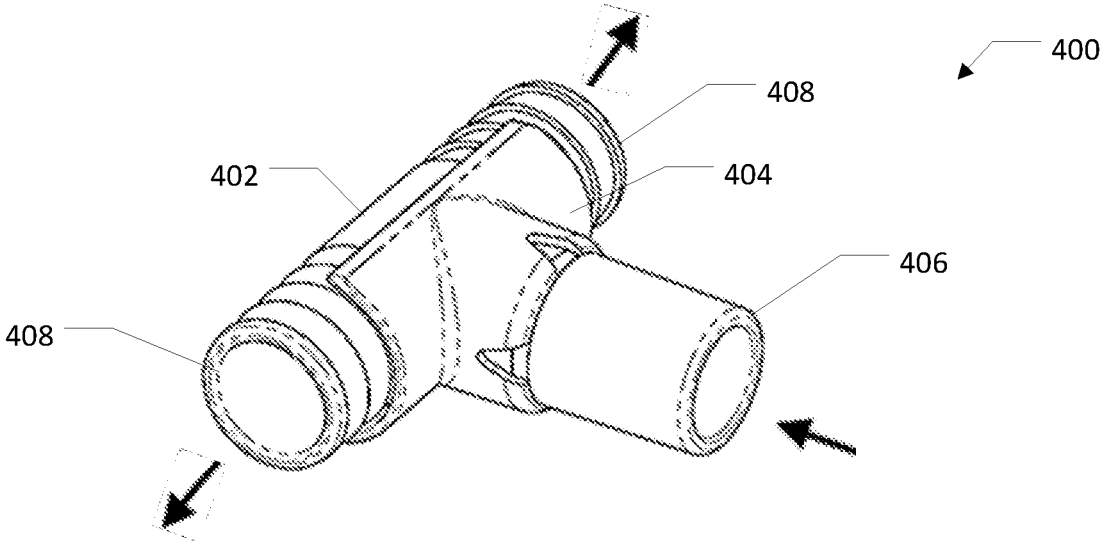

The air inlet nozzle 123 may also take a variety of suitable shapes for fluidly connecting an external air supply to the expandable air volume. For instance, FIGS. 4A and 4B illustrate schematics of an example air inlet nozzle 400 with a T-shaped configuration. The example air inlet nozzle 400 includes an interior portion 402 and an exterior portion 404. The interior portion 402 may be disposed partially within the expandable air volume such that its air outlet ends 408 are within the expandable air volume and its air inlet end 406 is outside the expandable air volume. The air inlet end 406 may be placed through an opening in the exterior portion 404 and the exterior portion 404 may slide onto the interior portion 402 as illustrated. In some examples, the air inlet nozzle 400 may have a notch and notch opening that couples the exterior portion 404 to the interior portion 406, as described in more detail below in connection with FIGS. 6A and 6B. When the example air inlet nozzle 400 is installed in the levitation system 120, either the first layer of material 124 or the second layer of material 121, or both, is between the interior portion 402 and the exterior portion 404 such that the air inlet nozzle 400 may receive air into its air inlet end 406 (as illustrated by the arrow) and deliver that air to the expandable air volume through its air outlet ends 408 (as illustrated by the arrows).

Figure 5A:
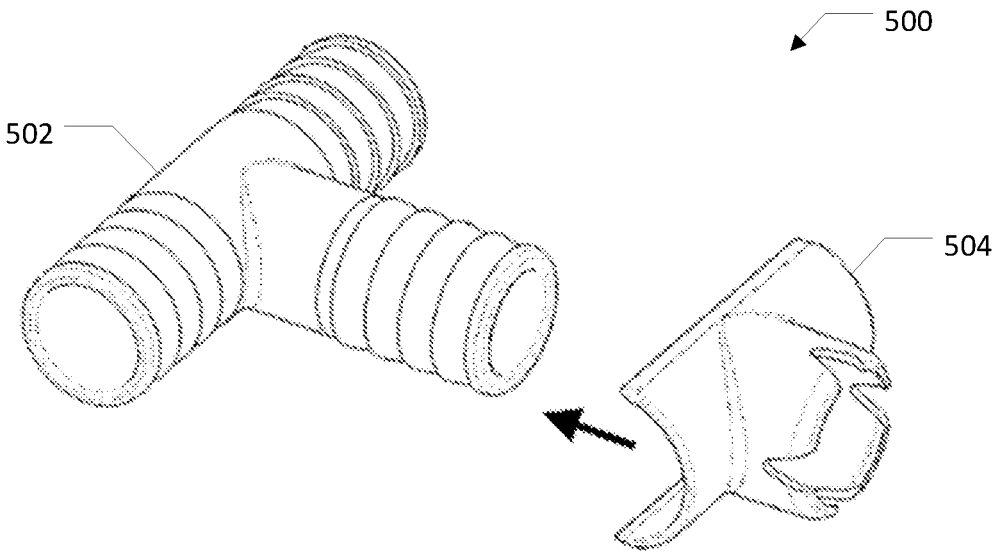
FIGS. 5A and 5B illustrate schematics of an example T-shaped air inlet nozzle with barbs on the inlet end, according to an example of the present disclosure.
Figure 5B:
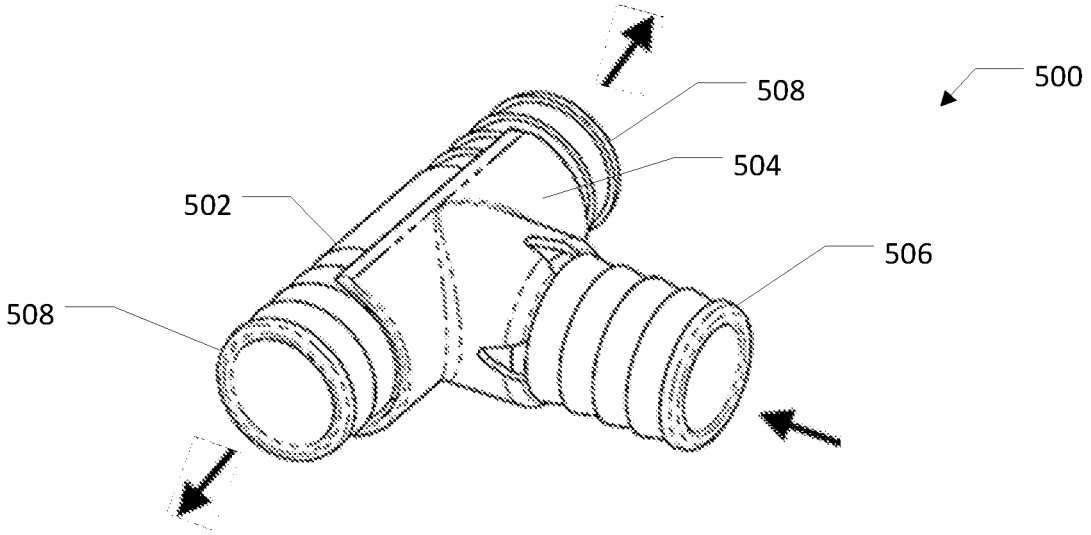

FIGS. 5A and 5B illustrate an alternate example of the air inlet nozzle 400, specifically the air inlet nozzle 500. The air inlet nozzle 500 includes an air outlet end 506 with barbs whereas the air outlet end 406 does not include barbs. The barbs may help create a better seal between the air inlet nozzle 500 and the tube 125 that delivers the air from the external air supply such that less air escapes between the air inlet nozzle 500 and the tube 125 when the expandable air volume is being filled with air. For example, the barbs may help the tube 125 stay in place on the air inlet end 506 of the example air inlet nozzle 500.

Figure 6B:
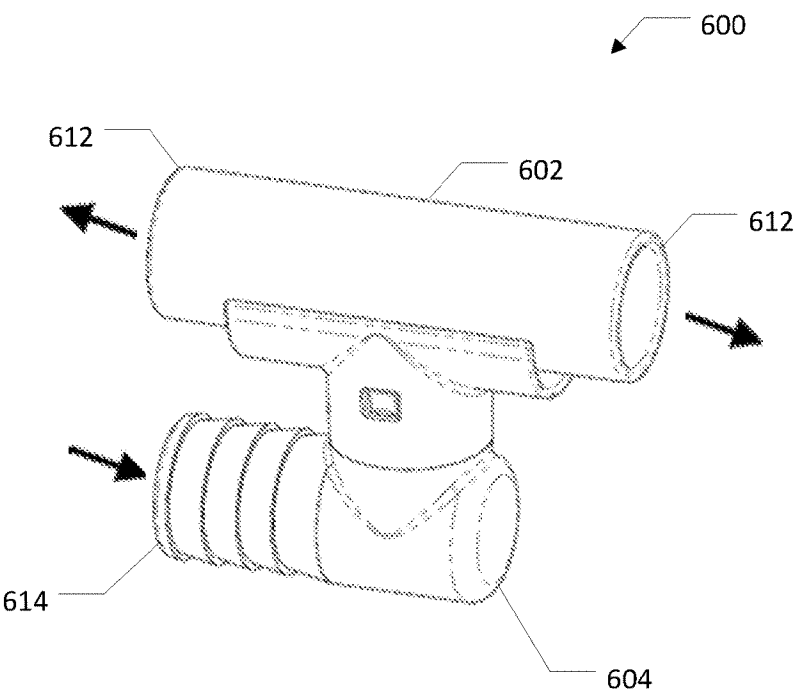
FIGS. 6A and 6B illustrate schematics of an example L-shaped air inlet nozzle, according to an example of the present disclosure.
Figure 6A:
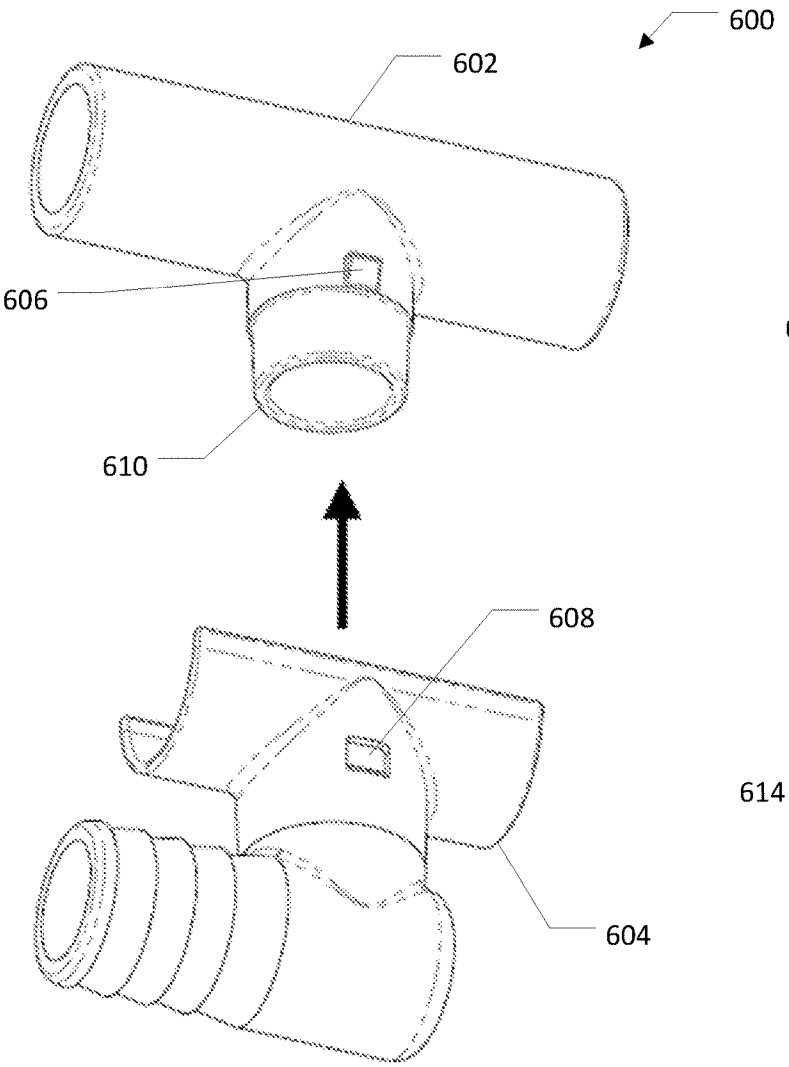

FIGS. 6A and 6B illustrate schematics of an example air inlet nozzle 600 that has an L-shaped configuration. Similar to the example air inlet nozzles 400 and 500, the example air inlet nozzle 600 has an interior portion 602 and an exterior portion 604. The interior portion 602 may be disposed partially within the expandable air volume such that its air outlet ends 612 are within the expandable air volume and its air inlet end 610 is outside the expandable air volume. In some instances, as illustrated in FIGS. 6A and 6B, the air inlet nozzle 600 may include a notch 606 on the interior portion 602 and a notch opening 608 on the exterior portion 604. The notch opening 608 may snap onto the notch 606 such that the exterior portion 604 couples to the interior portion 602. As with the example air inlet nozzles 400 and 500, when the example air inlet nozzle 600 is installed in the levitation system 120, either the first layer of material 124 or the second layer of material 121, or both, is between the interior portion 602 and the exterior portion 604 such that the air inlet nozzle 600 may receive air into its air supply end 614 (as illustrated by the arrow) and deliver that air to the expandable air volume through its air outlet ends 612 (as illustrated by the arrows).

Different than the example air inlet nozzles 400 and 500, the exterior portion 604 of the air inlet nozzle 600 has substantially a right angle to it (e.g., an L-shape) such that the air supply end 614 faces along the same plane as the air outlet ends 612. The right angle, or L-shaped configuration, may be enhance the air inlet nozzle's 600 compatibility with an external air supply, specifically the tube 125 of the external air supply, in some instances.

For example, in some instances, a person may not want the air inlet nozzle 123 (e.g., the air inlet nozzle 400, 500, or 600) to be visible and sticking out from the sides or foot of the bed when the head of the bed is up against a wall. Accordingly, the person may orient the levitation system 120 between a mattress and a box spring or platform such that the air inlet nozzle 123 is facing the wall at the head of the bed. In such instances, if the levitation system 120 includes the example air inlet nozzle 400 or 500, the air inlet end 406 or 506 will face towards, and be very close to, the wall, thus making it difficult to attach the tube 125 of the external air supply to the air inlet end 406 or 506. For example, the tube 125 will have to bend at an angle and may accordingly be partially or fully pinched, which restricts the air flow from the external air supply and may generate undesired pressure buildup. If the levitation system 120 in such instances instead includes the example air inlet nozzle 600, however, the tube 125 may attach to the air supply end 614 directly without bending because the exterior portion 604 is already bent at substantially a right angle. Accordingly, the example air inlet nozzle 600 may enhance compatibility with an external air supply in such instances.

In other examples, the air inlet nozzle 600 may be disposed in the levitation system 120 such that the air inlet nozzle 600 is disposed at the sides or foot of the bed. Similarly, the example air inlet nozzles 400 and 500 may be disposed in the levitation system 120 such that the air inlet nozzle 400 or 500 is disposed on any side of the bed.

Figure 7:
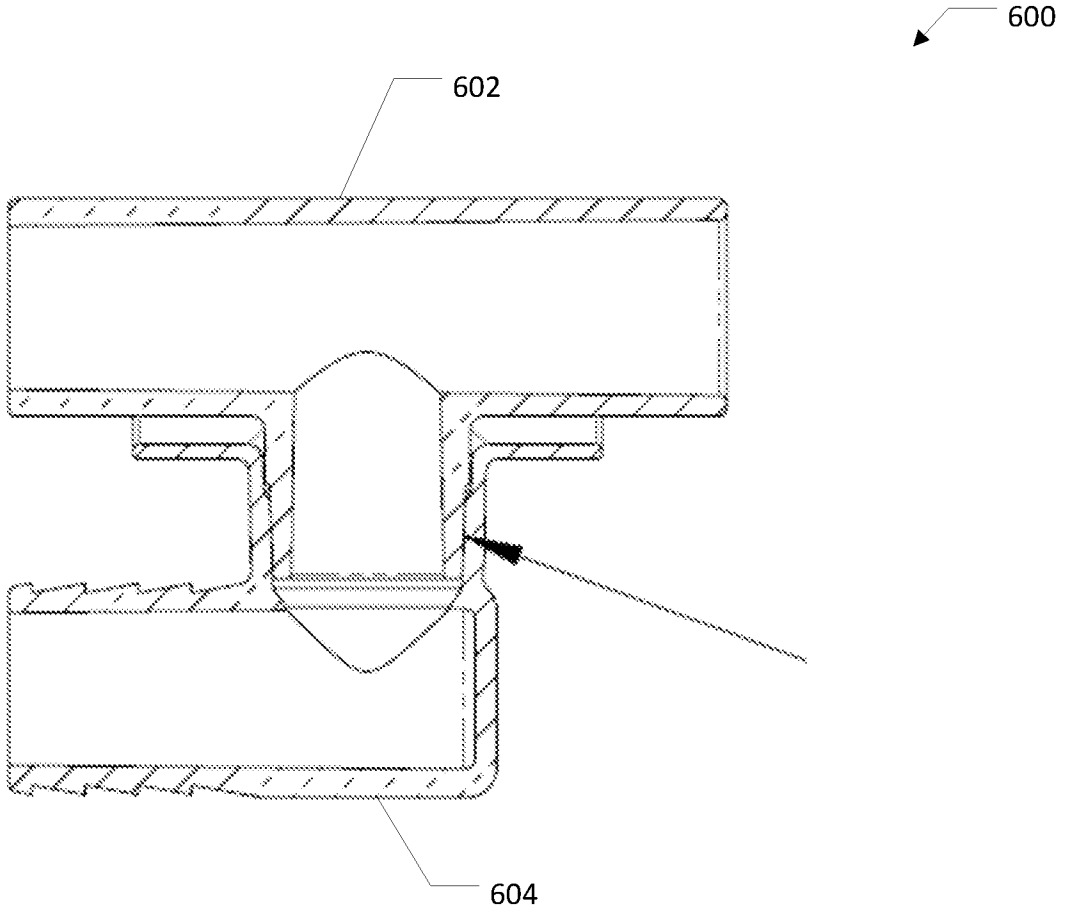
FIG. 7 illustrates a cross-sectional view of an example L-shaped air inlet nozzle, according to an example of the present disclosure.

FIG. 7 illustrates a cross-sectional view of the example air inlet nozzle 600. When the interior portion 602 and exterior portion 604 are coupled, the surfaces of both conform to one another such that minimal air escapes between the two portions, as is illustrated by the arrow. This configuration of the interior and exterior portions 602 and 604 may help a majority of the air from the external air supply reach the expandable air volume, thus increasing energy efficiency and enabling the levitation system 120 to function optimally.

Figure 8B:
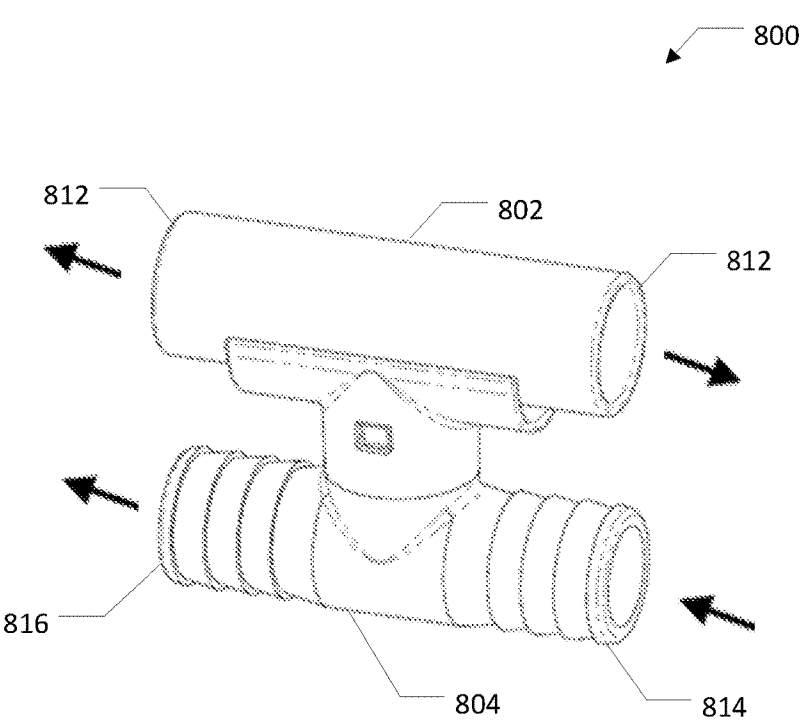
FIGS. 8A and 8B illustrate schematics of an example dual-sided air inlet nozzle, according to an example of the present disclosure.
Figure 8A:
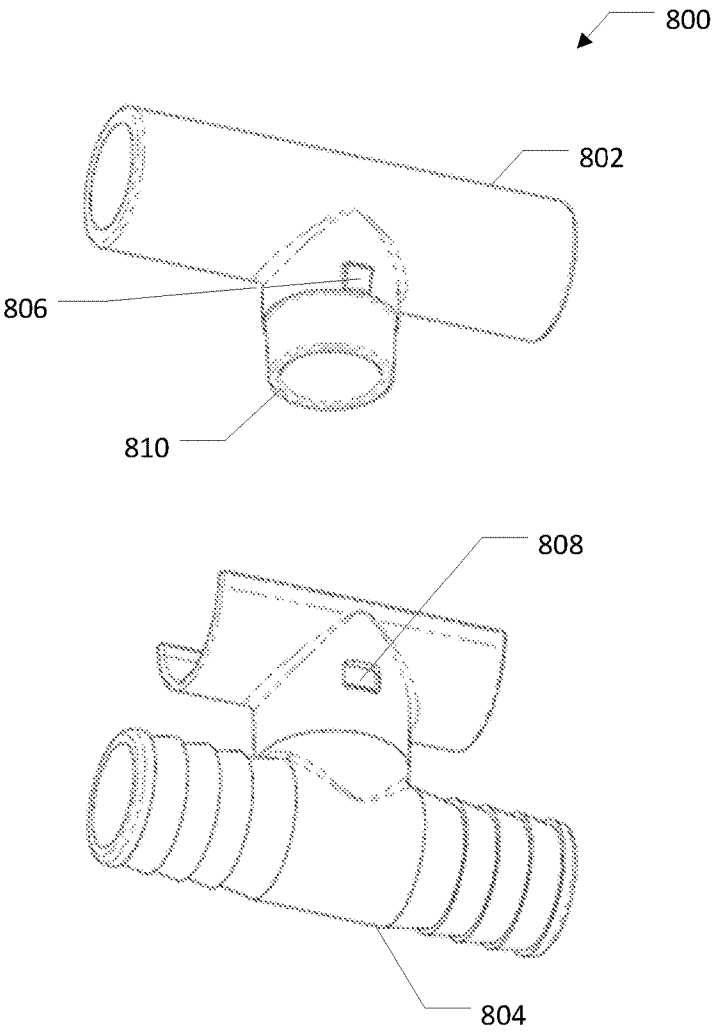

FIGS. 8A and 8B illustrate schematics of an example air inlet nozzle 800 with a dual-sided configuration. Similar to the example air inlet nozzles previously described, the example air inlet nozzle 800 includes an interior portion 802 and an exterior portion 804. The interior portion 802 may be disposed partially within the expandable air volume such that its air outlet ends 812 are within the expandable air volume and its air inlet end 810 is outside the expandable air volume. In some instances, as illustrated in FIGS. 8A and 8B, the air inlet nozzle 800 may include a notch 806 on the interior portion 802 and a notch opening 808 on the exterior portion 804. The notch opening 808 may snap onto the notch 806 such that the exterior portion 804 couples to the interior portion 802. As with the other example air inlet nozzles, when the example air inlet nozzle 800 is installed in the levitation system 120, either the first layer of material 124 or the second layer of material 121, or both, is between the interior portion 802 and the exterior portion 804. The example air inlet nozzle 800, however, has both an air supply end 814 and an air supply connector end 816. As will be described in more detail below in connection with FIG. 18, the air inlet nozzle 800 may receive air through its air supply end 814, which then may partially exit through its air outlet ends 812 and partially exit through its air supply connector end 816, as illustrated by the arrows. In some instances, the air outlet ends 812 may be an airflow check valve to ensure one-way air flow.

Figure 9:
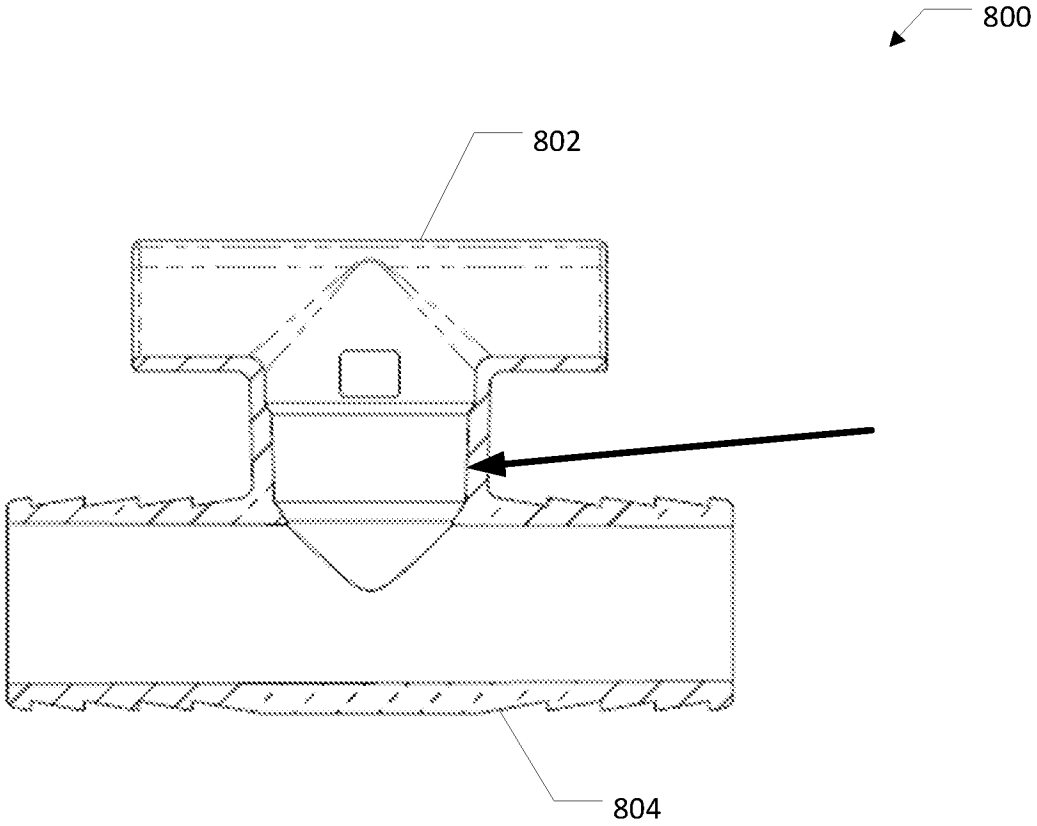
FIG. 9 illustrates a cross-sectional view of an example dual-sided air inlet nozzle, according to an example of the present disclosure.

FIG. 9 illustrates a cross-sectional view of the example air inlet nozzle 800. When the interior portion 802 and exterior portion 804 are coupled, the surfaces of both conform to one another such that minimal air escapes between the two portions, as is illustrated by the arrow. This configuration of the interior and exterior portions 802 and 804 may help a majority of the air from the external air supply reach the expandable air volume, thus increasing energy efficiency and enabling the levitation system 120 to function optimally. Additionally, the above described example air inlet nozzles 400, 500, and 800 may provide manufacturing efficiency as compared to other manufacturing methods, such as methods that fixedly attach an air input to the levitation system 120. In other examples, the air inlet nozzle 123 may have other suitable configurations than those illustrated. For example, the air inlet nozzle 123 may include an exterior portion bent at more or less than a right angle, or that has more than one air supply connector.

Figure 10:
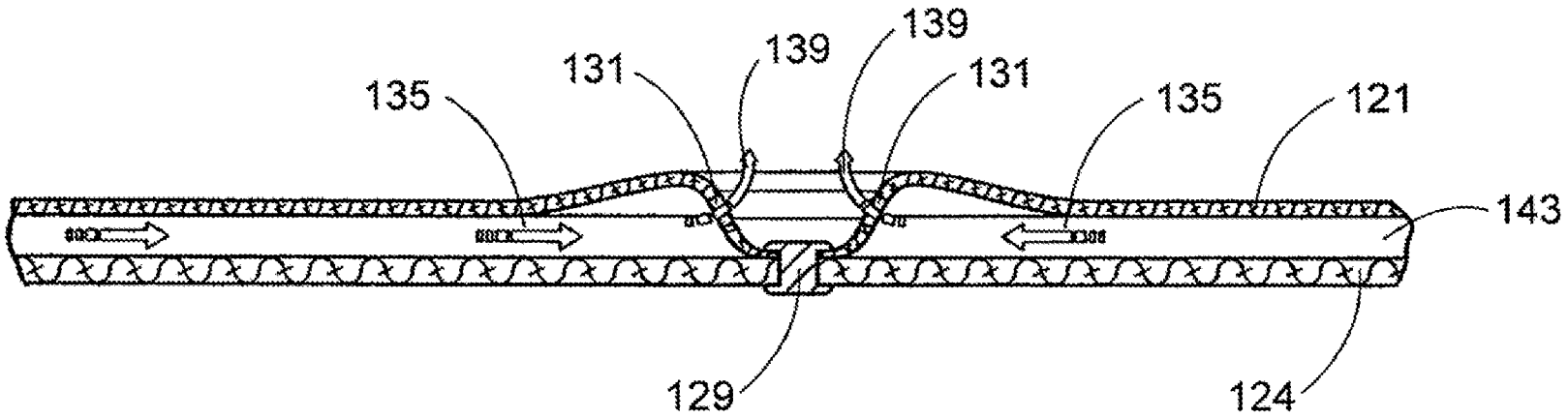
FIG. 10 illustrates a cross-sectional schematic of an attachment point of a levitation system provided with air, according to an example of the present disclosure.

Returning to FIG. 3, in some examples the second layer of material 121 of the levitation system 120 may include multiple holes 131 for continuously releasing air that the external air supply (e.g., the air pump 127) supplies to the expandable air volume. In some examples, as illustrated in FIG. 10, the levitation system 120 includes an attachment point 129 to attach a point within the periphery of the second layer of material 121 to a point within the periphery of the first layer of material 124 (e.g., at or near a center point of both the first and second layers 124 and 121). For example, the attachment point 129 may include suitable fastening means such as a grommet, heat-sealing, stitching, glue, etc. As shown in FIG. 10, once the external air supply provides air to the air intake nozzle 123, the air raises the second layer of material 121 away from the first layer of material 124 as shown to expand the expandable air volume. The attachment point 129 may help create air channels 143 in the expandable air volume for the airflow 135 from the air inlet nozzle 123 through and out the holes 131, as illustrated by the arrows. The air leaving out the holes 131 may form an air column 139 adjacent the attachment point 129, that may help lift or levitate the center portion of a mattress above the levitation system 120.

The attachment point 129 may also help create a substantially uniform air cushion from the expandable air volume such that the mattress is stable on top of the expandable air volume. For example, in certain instances, the attachment point 129 is at or near the center of the first and second layers of material 124 and 121 and supplied air fills the expandable air volume uniformly around the attachment point 129. Because no side of the expandable air volume is filled more than another, the mattress does not tilt and rests in a stable manner above the expandable air volume. In some instances, the attachment point 129 may be a length of material that attaches the inside top layer of fabric to an inside bottom layer of fabric. In other instances, the attachment point 129 may be multiple attachment points (e.g., one or more attachment points 129), or a continuous segment of attachment points that is interior, or separate from, the perimeter of the expandable air volume. Alternatively, the attachment point 129 may be multiple attachment points (e.g., one or more attachment points 129), or a continuous segment of attachment points that is in communication with the perimeter of the expandable air volume.

Figure 11A:
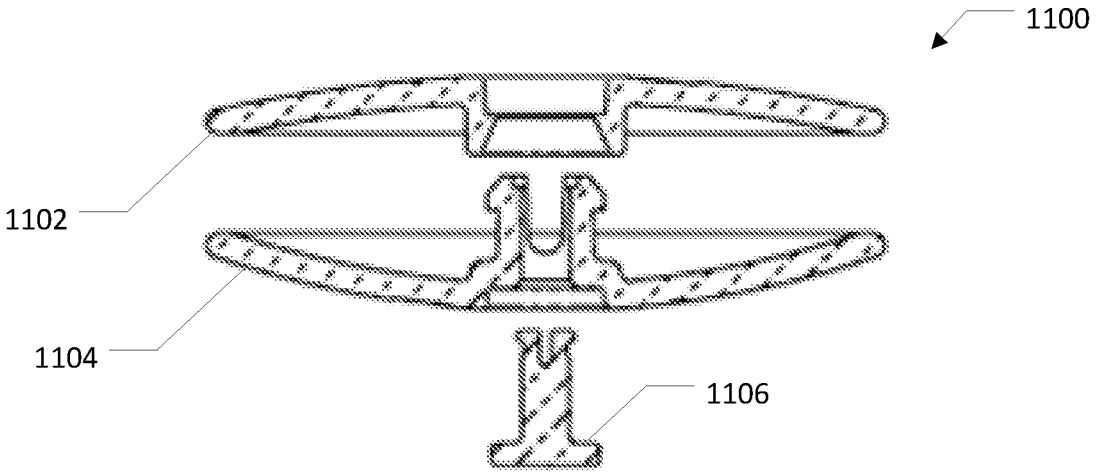
FIGS. 11A, 11B, and 11C illustrate schematics of an example grommet, according to an example of the present disclosure.
Figure 11B:
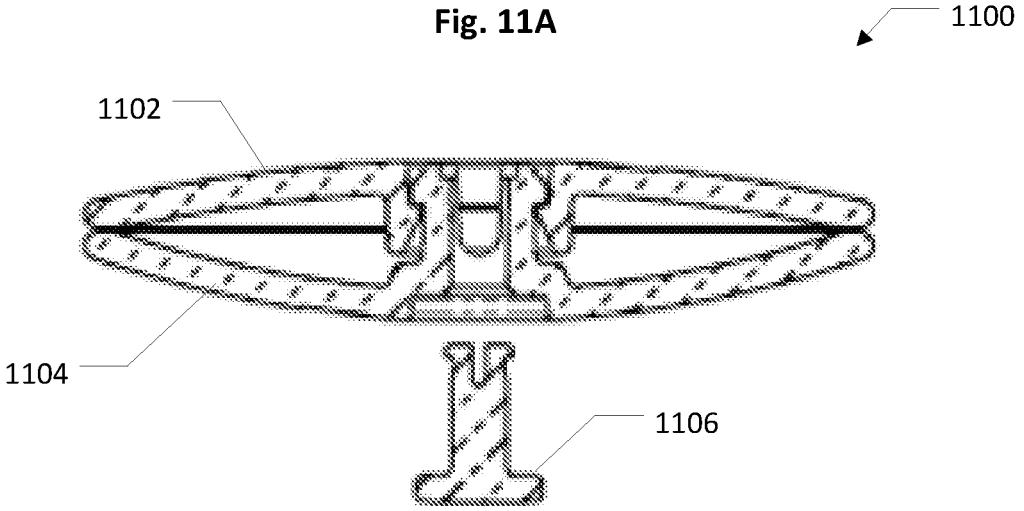
Figure 11C:
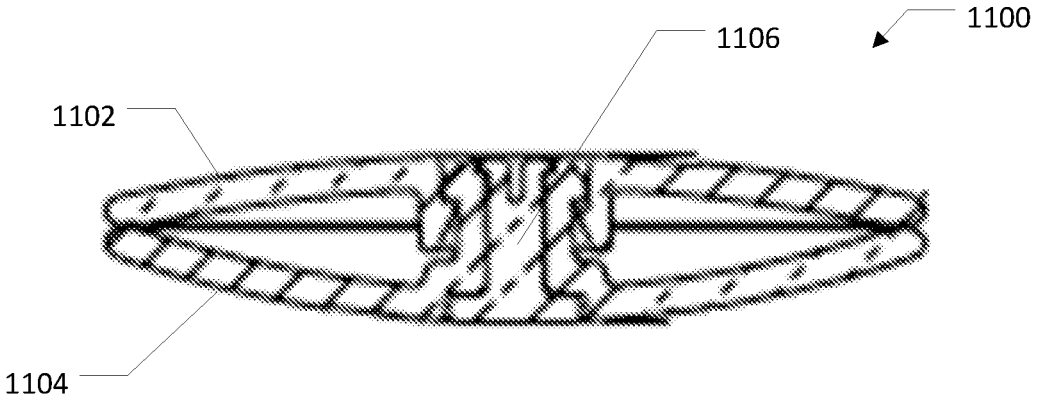

FIGS. 11A, 111B, and 11C illustrate cross-sectional views of an example grommet 1100 that may used as an attachment point 129. The example grommet 1100 may include an upper portion 1102, a lower portion 1104, and a fastener 1106. As illustrated, the upper portion 1102 may be placed together with the lower portion 1104, and the fastener 106 may be placed through a center opening of both the upper and lower portions 1102 and 1104 to snap into place and secure the upper portion 1102 to the lower portion 1104. When installed in the levitation system 120, the upper portion 1102 of the example grommet 1100 may be disposed on the outer surface of either the first layer of material 124 or the second layer of material 121, and the lower portion 1104 of the example grommet 1100 may be disposed on the outer surface of the other layer 124 or 121. In such examples, the first layer of material 124 and second layer of material 121 both include a hole such that the fastener 1106 may slide through the upper portion 1102, the first layer of material 124, the second layer of material 121, and the lower portion 1104 to snap into place and secure the upper portion 1102 of the example grommet 1100 to the lower portion 1104 of the example grommet 1100 with the first and second layers of material 124 and 121 between the upper and lower portions 1102 and 1104. This example grommet 1100 configuration may provide manufacturing efficiency as opposed to other above described fastening means.

Figure 12:
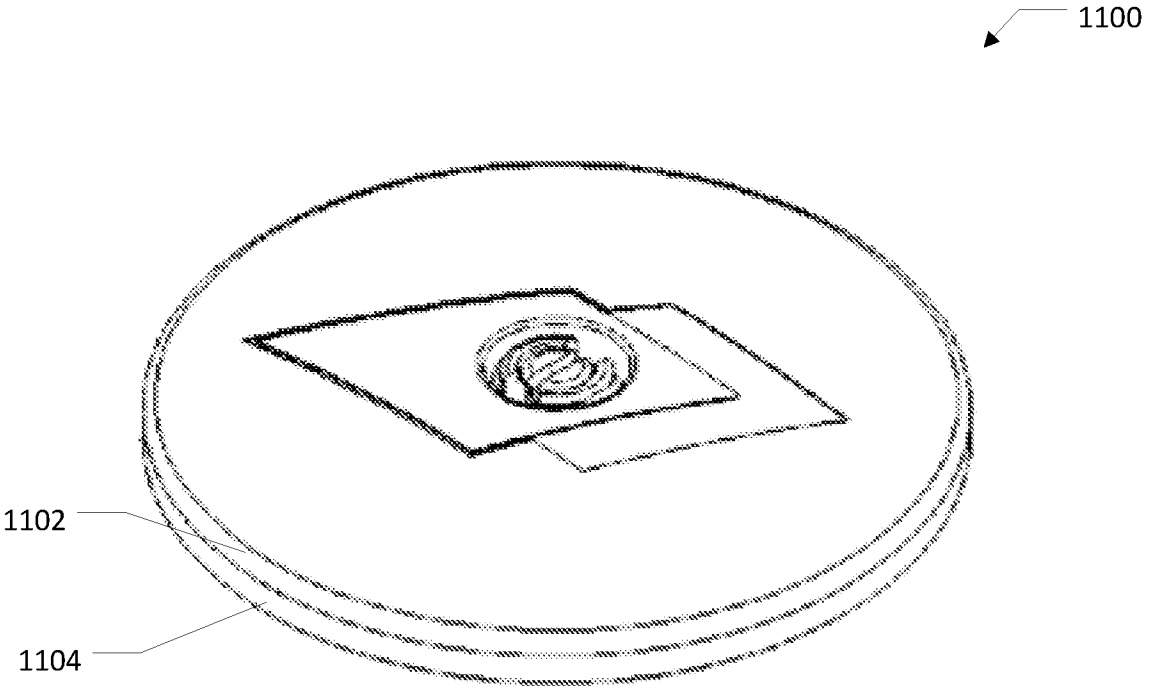
FIG. 12 illustrates a perspective view of an example grommet, according to an example of the present disclosure.

FIG. 12 illustrates a perspective view of the example grommet 1100. In other examples, the grommet 1100 may have other suitable configurations. For example, the grommet 1100 may be oval, square, rectangular, etc. In other examples, the grommet 1100 may also have an upper portion and lower portion of different sizes. Consistent with the description above, FIG. 12 shows that when installed in the levitation system 120, the first layer of material 124 and the second layer of material 121 may be between the upper portion 1102 and the lower portion 1104 of the example grommet 1100.

Figure 13:
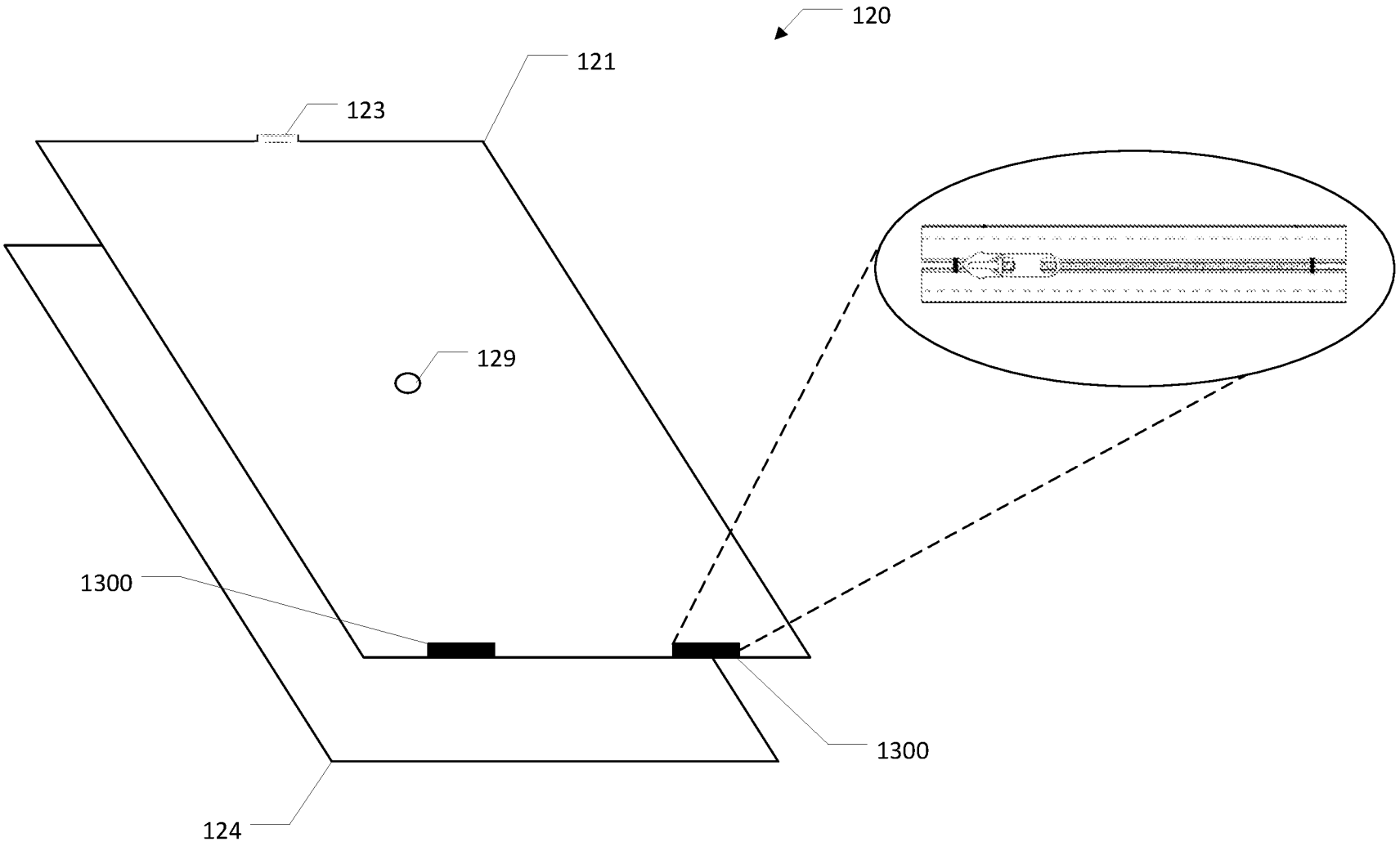
FIG. 13 illustrates an exploded view of a levitation system with adjustable openings, according to an example of the present disclosure.

FIG. 13 shows an exploded view of the levitation system 120, including the first layer of material 124, the second layer of material 121, and an example air inlet nozzle 123 (e.g., the air inlet nozzle 400, 500, 600, or 800). In some aspects of the present disclosure, as illustrated in FIG. 13, the example levitation system 120 may include one or more adjustable openings 1300 that control the amount of air released from the expandable air volume as an external air supply provides air to the expandable air volume. For example, the adjustable openings 1300 may be zippered openings as shown in the magnified portion of FIG. 13. The amount of air released from the expandable air volume is proportional to the amount that the zippered adjustable openings 1300 are open. FIG. 13 illustrates the levitation system 120 having two adjustable openings 1300, though in other examples, the levitation system 120 may have more or less than two adjustable openings 1300. In certain examples, the adjustable openings 1300 may also be dispersed on various sides of the levitation system 120 and not all on the same side as illustrated. In various examples, the adjustable openings 1300 may be disposed on the first layer of material 124, or on both the first and second layers of material 124 and 121. Stated differently, the one or more holes may be formed between the first layer and the second layer. Alternatively, the holes may be formed from a portion of the first layer and the second layer; a portion of the second layer and the first layer; a portion of the first layer and a portion of the second layer, and/or the like. Additionally, FIG. 13 illustrates that the air inlet nozzle 123 and the adjustable openings 1300 are on opposite sides of the levitation system 120, though in other examples, the air inlet nozzle 123 may be on the same side, or on an adjacent side, to the adjustable openings 1300. FIG. 13 illustrates that an attachment point 129 may be included in the levitation system 120.

Figure 14A:
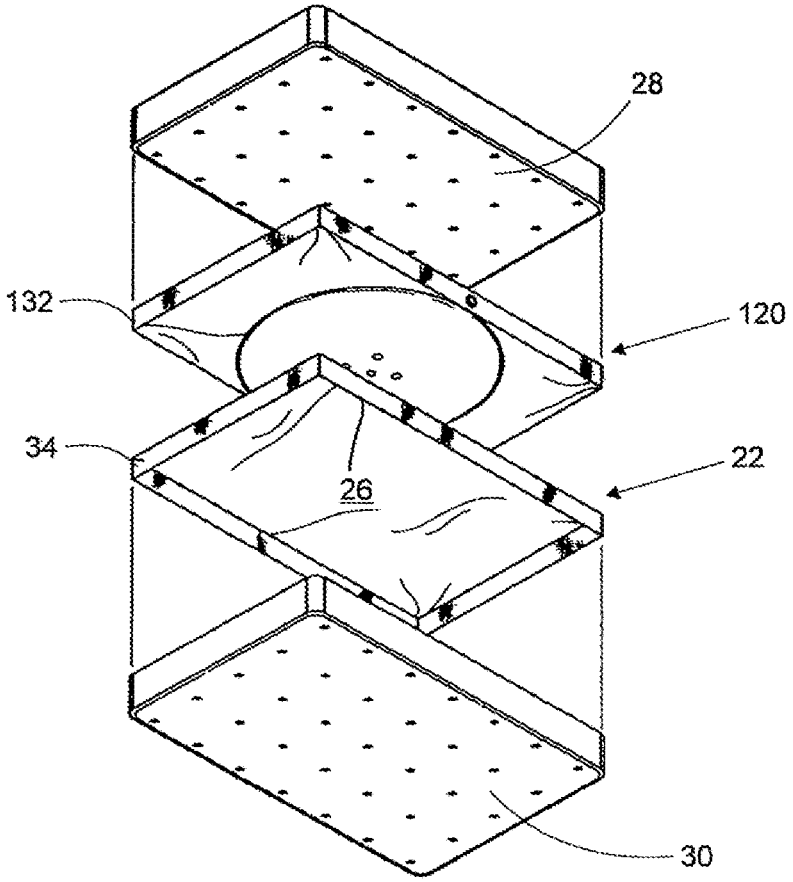
FIGS. 14A and 14B illustrate schematics of a levitation system with a band securing it to the underside of a mattress, and used in conjunction with an opposing cover on a box spring, according to an example of the present disclosure.
Figure 14B:
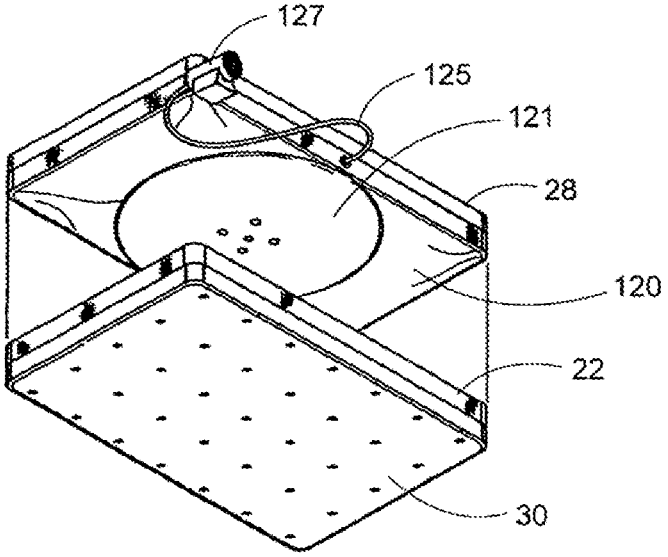

In some aspects of the present disclosure, the levitation system 120 may include a mechanism that secures the levitation system 120 to either a mattress, a box spring, or a platform. For example, as show in FIG. 3, the levitation system 120 may include a stretchable band 132 attached to the periphery of the first layer of material 124. In other examples, the stretchable band 132 may be attached to both the first and second layers of material 124 and 121 at the same attachment point. The stretchable band 132 enables the levitation system 120 to be removably secured to the underside of a mattress 28, as shown in FIGS. 14A and 14B. In an alternate example, the stretchable band 132 may enable the levitation system 120 to be removably secured to the topside of a box spring. The stretchable band 132 may be formed from an elastic material or other suitable stretchable materials, for example, spandex, mesh, stretchable fabric, or an elastic banding, and may be attached to the first or second layer of material 124 or 121 by any suitable means, for example, by sewing. In some examples, the stretchable band 132 may be formed integrally from the same material as the first or second layer of material 124 or 121 (e.g., it does not need to be attached), and may be secured to a mattress 28 or box spring 30 by way of a drawstring (not shown) or other attachment method.

In other examples, the levitation system 120 may include other suitable mechanisms to secure it to a mattress, a box spring, or a platform. For example, the levitation system 120 may include straps (e.g., elastic, Velcro®, etc.) that are attached on two opposing sides of the levitation device 120 and may be placed below a mattress, box spring, or platform such that the straps wrap around the mattress, box spring, or platform and secure the levitation device 120 to the mattress, box spring, or platform. In other examples, one or two ends of straps can be sewn into the expandable air volume and/or be formed from the expandable air volume to allow it to be held snug to bottom surface of mattress. In yet another example, such straps can be sewn to side of an encasement forming an expandable air volume to allow it to be held snug to bottom surface of a mattress. In other examples, the straps may attach directly to the expandable air volume to hold the expandable air volume snug to the bottom surface of a matters. One or more straps may attach directly to the expandable air volume that is formed as a cover. One or more straps may attach directly to the bands of the cover. In yet other examples, one or more straps may attach directly to the expandable volume formed as a six-sided zip-on mattress encasement. One or more straps may attach directly to the sides of a six-sided zip-on mattress encasement.

Figure 15A:
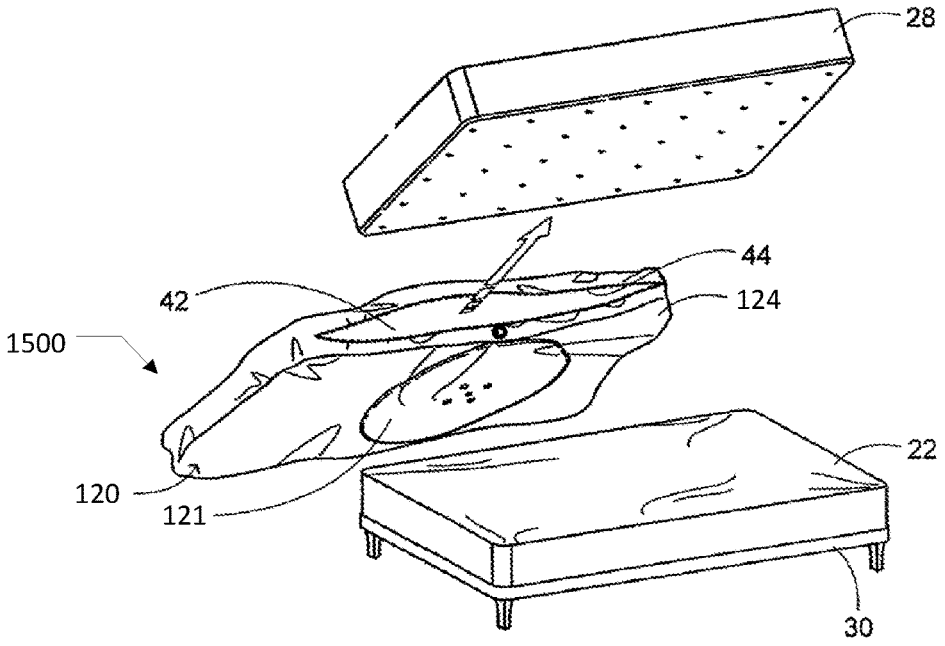
FIGS. 15A and 15B illustrate schematics of a levitation system form integrally with a casing that fully encases a mattress, and used in conjunction with an opposing cover on a box spring, according to an example of the present disclosure.
Figure 15B:
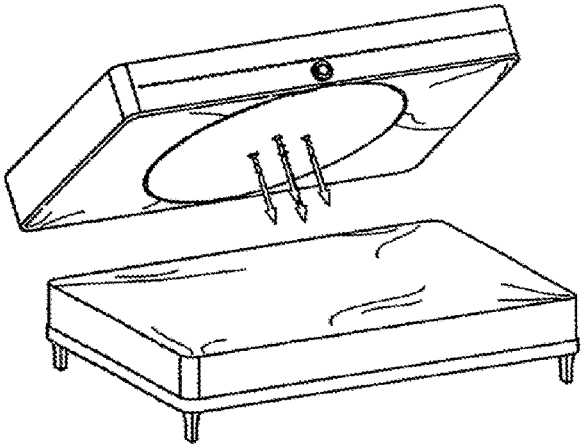

In another example, as illustrated in FIGS. 15A and 15B, the levitation system 120 may be formed integral with a casing 1500 sized to fully encase a mattress 28. In other examples, the casing 1500 with the levitation system 120 may fully encase a box spring 30. The casing 1500 may include an opening 42 along one edge of the casing 1500 to enable the mattress 28 to be placed inside the casing 1500 such that the levitation system 120 faces downwardly. A conventional fastener, such as a zipper 44, may be used to close the opening 42. In the illustrated example, the outward surface of both the first and second layers of material 124 and 121 (e.g., facing towards the opposing cover 22) are slick sides, as will be described more below.

In another example, the levitation system 120 may be formed integral with the underside of a mattress, or the topside of a box spring or platform. In other words, the levitation system 120 may be a part of the mattress, box spring, or platform and not a separate component that needs to be secured. In such instances, the mattress, box spring, or platform with the integral levitation system 120 may include an integral air conduit within the mattress, box spring, or platform that connects the integral levitation system 120 with an external or internal air supply.

As illustrated in FIGS. 14A, 14B, 15A, and 15B, the levitation system 120 may be used in conjunction with an opposing cover 22. For instance, the levitation system 120 is shown removably secured to the underside of the mattress 28 and the opposing cover 22 is shown removably secured to the topside of a box spring 30. In other instances, the levitation system 120 may be removably secured to the topside of the box spring 30 and the opposing cover 22 may be removably secured to the underside of the mattress 28. The opposing cover 22 may be removably secured in the same suitable manners as described above with regard to the levitation system 120. For example, the opposing cover 22 may include a stretchable band 34, similar to or the same as, the stretchable band 132. The opposing cover 22 may also include a layer of material 26 sized according to the corresponding mattress with which it will be used (e.g., king, queen, twin, etc.).

In another example, the opposing cover 22 may be formed integral with the underside of a mattress, or the topside of a box spring or platform. In other words, the opposing cover 22 may be a part of the mattress, box spring, or platform and not a separate component that needs to be secured.

Figure 16A:
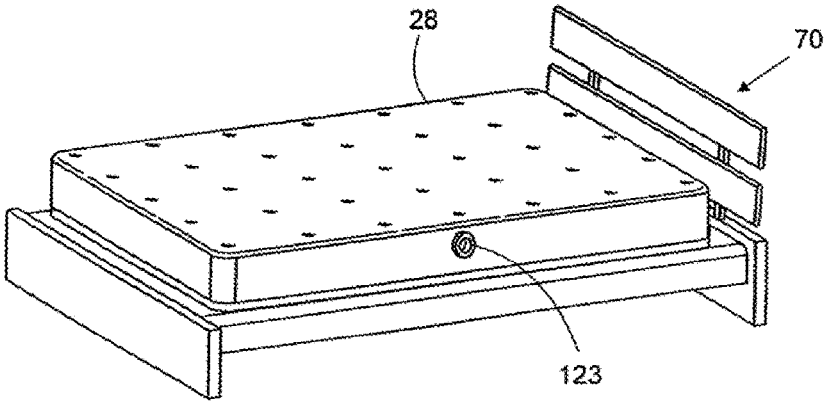
FIGS. 16A and 16B illustrate schematics of a levitation system used in conjunction with a platform bed, according to an example of the present disclosure.
Figure 16B:
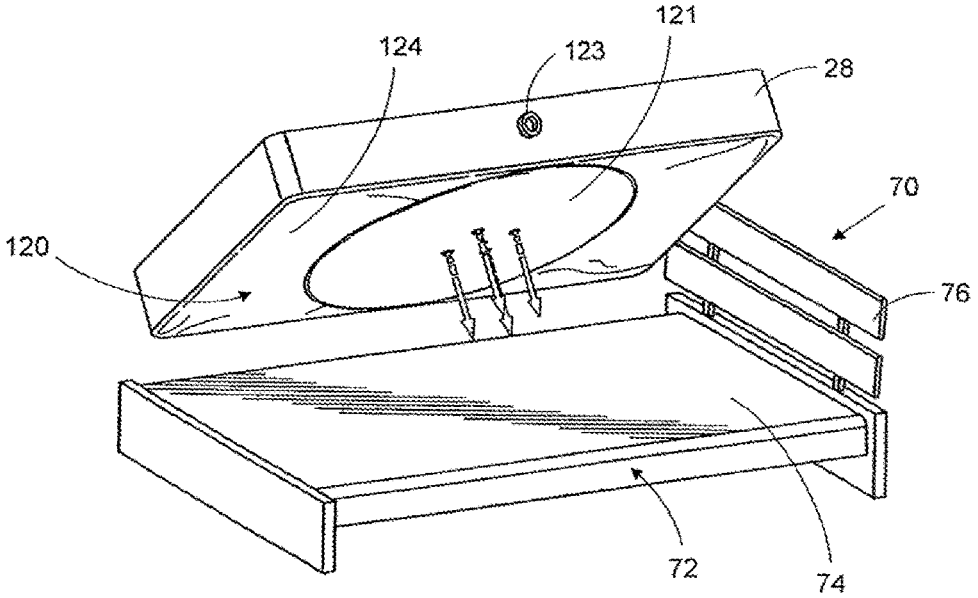

For example, as illustrated in FIGS. 16A and 16B, the opposing cover 22 may be formed integral with a platform bed 70. Specifically, the opposing cover 22 may instead be provided by the surface 74 of the platform 72. The surface 74 may be formed with a slick surface, as will be described in more detail below. For example, the surface 74 may be formed from a material with a slick surface or may have a coating, etc. that makes the surface 74 slick. When a person operates the levitation system 120 to rotate the mattress 28, the person may remove the headboard 76 from the platform 74 to allow the mattress 28 to rotate. Once the mattress is rotated, the person may reattach the headboard 76 to the platform 74.

As introduced above, in some examples, the first layer of material 124 or second layer of material 121 of the levitation system 120 has a slick side with a relatively low co-efficient of friction that faces towards the opposing cover 22. For instance, if the second layer of material 121 only covers a portion of the first layer of material 124, then at least the portion of the first layer of material 124 not covered and the second layer of material 121 have a "slick" side facing towards the opposing cover 22. In other instances, if the second layer of material 121 covers the extent of the first layer of material 124 to form the expandable air volume, then it may be that only the second layer of material 121 has a slick side facing towards the opposing cover 22. The layer of material 26 of the opposing cover 22 may also have a slick side with a relatively low co-efficient of friction that faces towards the levitation system 120. Accordingly, when the slick sides of the levitation system 120 and opposing cover 22 are in contact with one another the frictional force between the sides is reduced compared to non-slick sides. Further, when air is supplied to levitation system 120 from an external air supply, the levitation system 120 creates an air column or cushion between the two slick sides which lifts the mattress. The combination of the slick sides and the air column or cushion helps facilitate rotation of a mattress by a single person with minimal effort.

In some examples, the first layer of material 124 of the levitation system may have a second slick side that faces away from the opposing cover 22 and towards a mattress, box spring, or platform depending on how the levitation system 120 is oriented. In other examples, the first layer of material 124 may instead have a non-slick side having a relatively higher co-efficient of friction that faces away from the opposing cover 22 and towards the mattress, box spring, or platform. The non-slick side with a relatively higher co-efficient of friction may help secure the levitation system 120 to the underside of a mattress, or topside of a box spring or platform. In some examples, the layer of material 26 of the opposing cover 22 may have a non-slick side having a relatively higher co-efficient of friction that faces away from the levitation system 120. The non-slick side with a relatively higher co-efficient of friction may help secure the opposing cover 22 to the topside of a box spring or platform, or the underside of a mattress. By helping to secure the opposing cover 22, the non-slick side may help reduce or prevent unintended movement of the mattress relative to the box spring, bed skirt, or platform in a normal operation mode.

The first and second layers of material 124 and 121 of the levitation system 120 and the layer of material 26 of the opposing cover 22 may be composed of a variety of suitable materials that are bendable and amenable to being folded and stored in relatively small packages. For example, cloth is a suitable material. As described above, in some instances the levitation system 120 or the opposing cover 22 has a slick side and a non-slick side. In such instances, the non-slick side can be created on one side of a slick material by way of a coating or sewing or fusing a non-slick backing to one side of the slick material. For example, "20 Denier Heat Sealable (backside) 100% Nylon Rip Stop" material is suitable for use with the presently disclosed system. In other instances, other materials with similar coefficients of friction on the slick and non-slick sides may be suitable. In another example, the material may be nylon with a coating on one side, for example, urethane or other thermal plastic or heat sealable coating.

Examples of nylon rip stop material suitable for use with the presently disclosed system is available from various sources, such as, Quest Outfitters of Sarasota, Fla. (http://questoutfitters.com). Their nylon taffeta material is described in detail at http://questoutfitters.com/coated.html#HEAT SEALABLE, hereby incorporated by reference. Suitable nylon taffeta material is also available from Rockywoods in Loveland, Colo. (http://www.rockywoods.com). Their nylon taffeta material is described in detail at http://www.rockvwoods.com/Fabrics-Hardware-Patterns-Kits/Medium-Weight-Nylon-Fabrics/Heat-Sealable-70-Denier-Nylon-Taffeta, hereby incorporated by reference.

In some examples, non-woven materials may also be used for the levitation system 120 or opposing cover 22 having a slick side and a non-slick side. For example, Tyvek® polyethylene non-woven fabric, as manufactured by the DuPont Corporation and described in detail at http://www2.dupont.com/Products_and_Services/en_VN/nwn.html may be used. Other materials having two slick sides can also be used, for example, silicone impregnated nylon rip stop available from Seattle Fabrics, Inc., http://www.seattlefabrics.com/nylons.html.

Figure 17A:
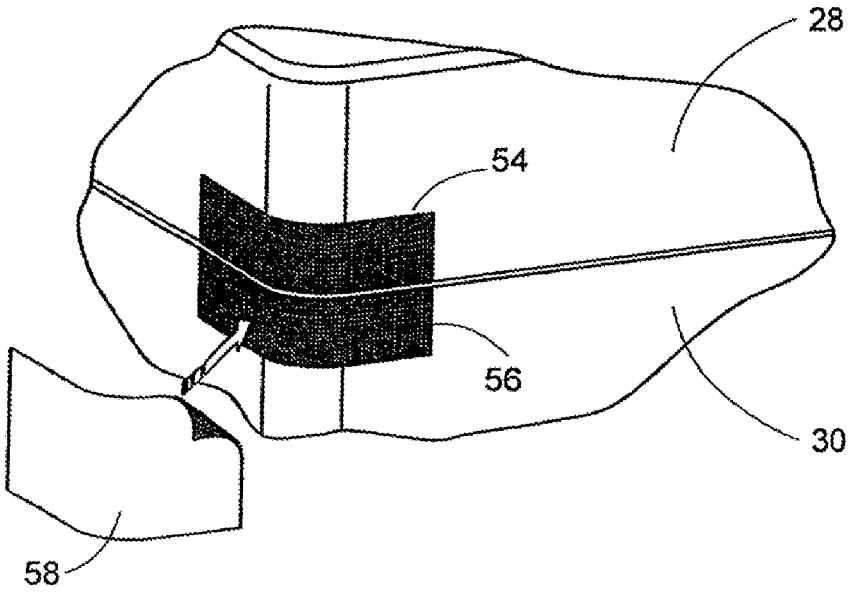
FIGS. 17A and 17B illustrate schematics of a fastening mechanism for securing a mattress to a box spring, according to an example of the present disclosure.
Figure 17B:
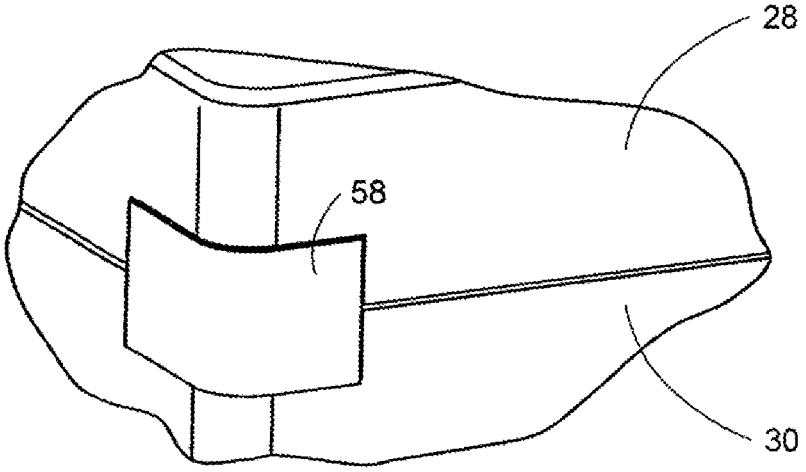

In certain aspects of the present disclosure, the presently disclosed system may include a mechanism to secure a mattress to a box spring or platform in order to prevent unintended mattress movement when the levitation system 120. For example, as illustrated in FIGS. 17A and 17B, fasteners, such as Velcro® fasteners, may be provided on the corners of the mattress 28 and box spring 30. In particular, permanent fasteners 54 may be provided on the mattress 28 corners and permanent fasteners 56 may be provided on the box spring 30 corners. A removable fastener 58 may then be attached to the permanent fasteners 54 and 56 when the mattress 28 is properly aligned with the box spring 30 to maintain the mattress 28 in a normal operation mode and prevent unintended movement. The removable fastener 58 may simply be removed in order to rotate the mattress 28 when the levitation system 120 is in operation and replaced once the mattress 28 is rotated. In other examples, other suitable mechanisms may be utilized to secure the mattress to the box spring (e.g., snap fasteners, fastening straps, string ties, a zipper, buttons, knot and hole fastener, etc.).

Figure 19A:
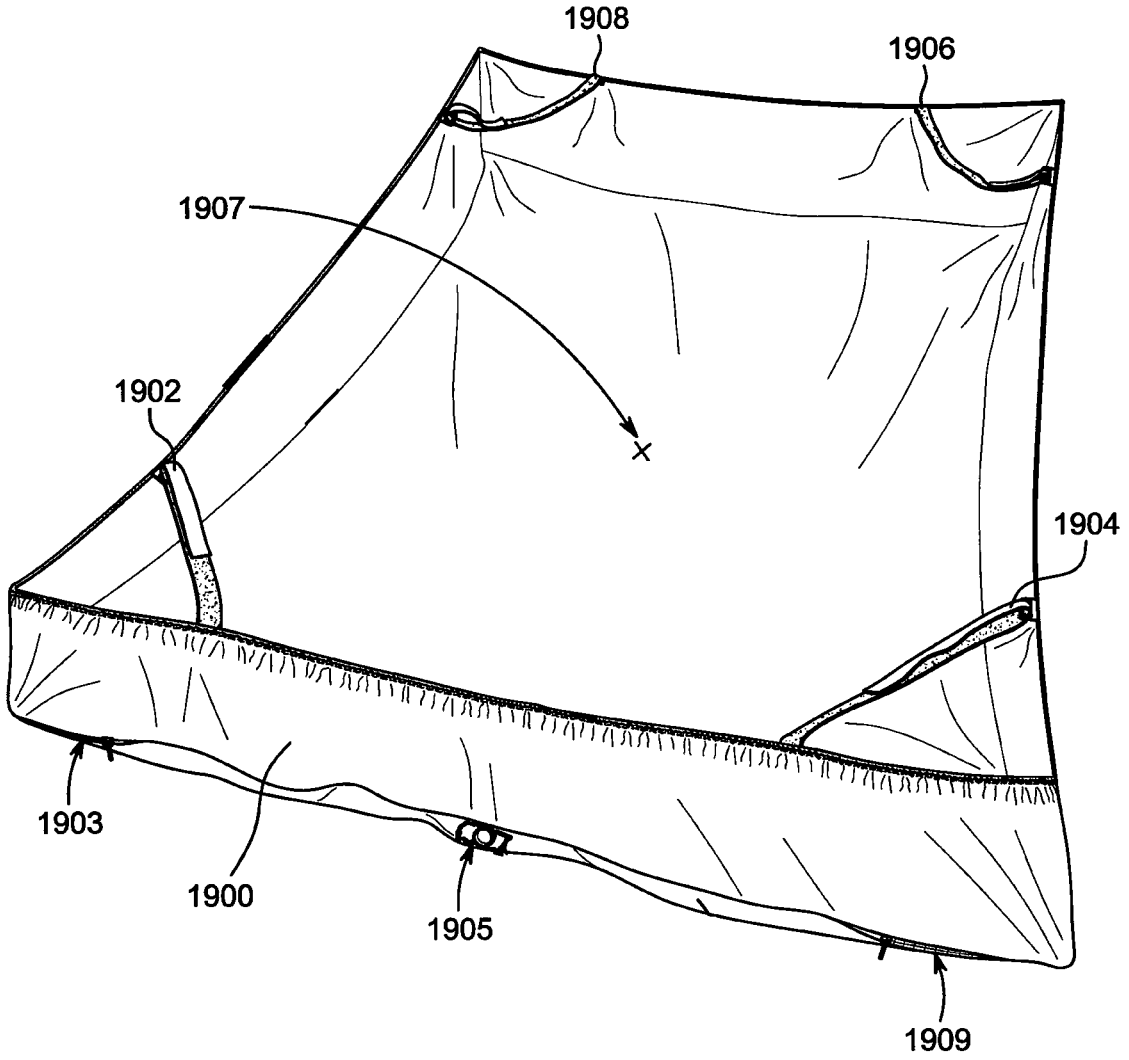
FIGS. 19A-19C illustrates a schematics of a levitation system with fasteners, according to one embodiment of the present disclosure.
Figure 19B:
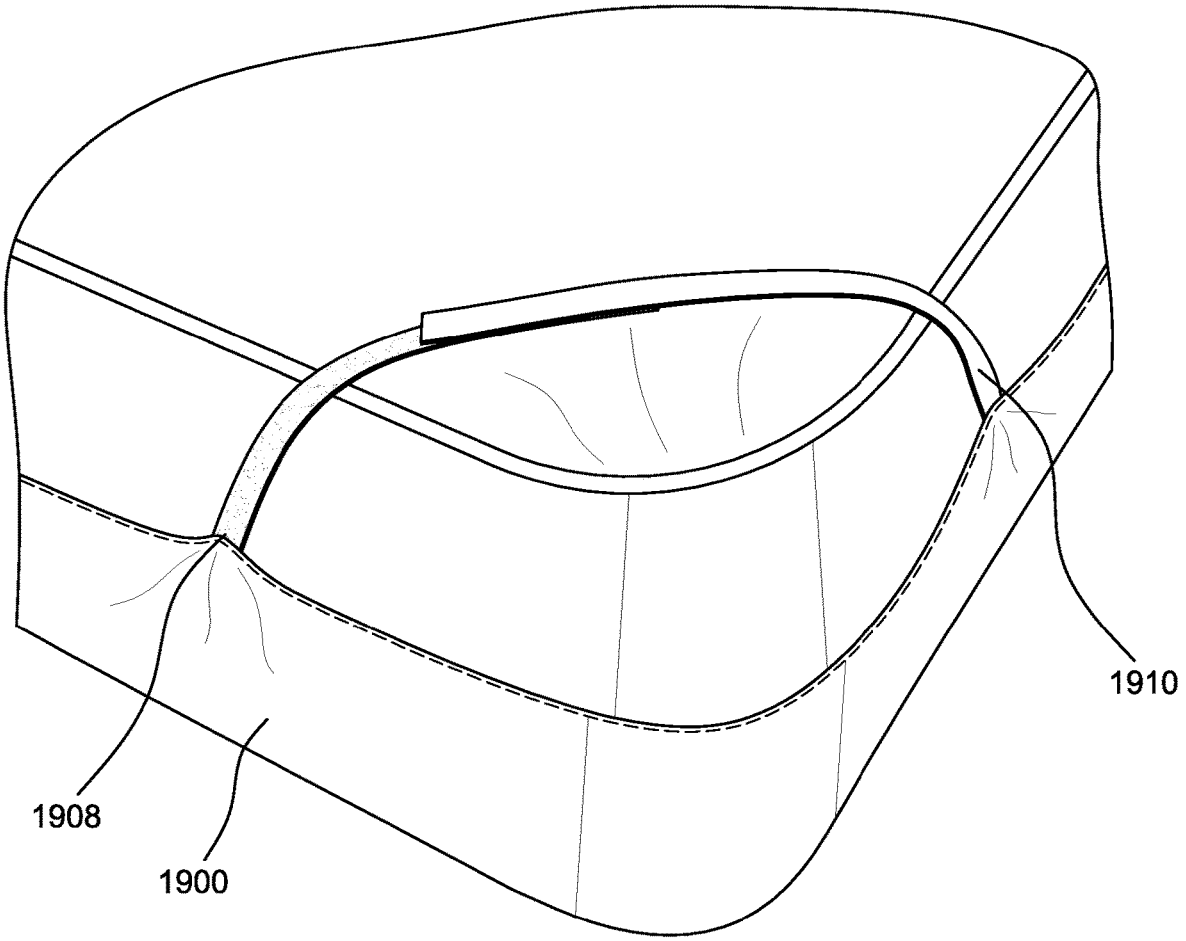
Figure 19C:
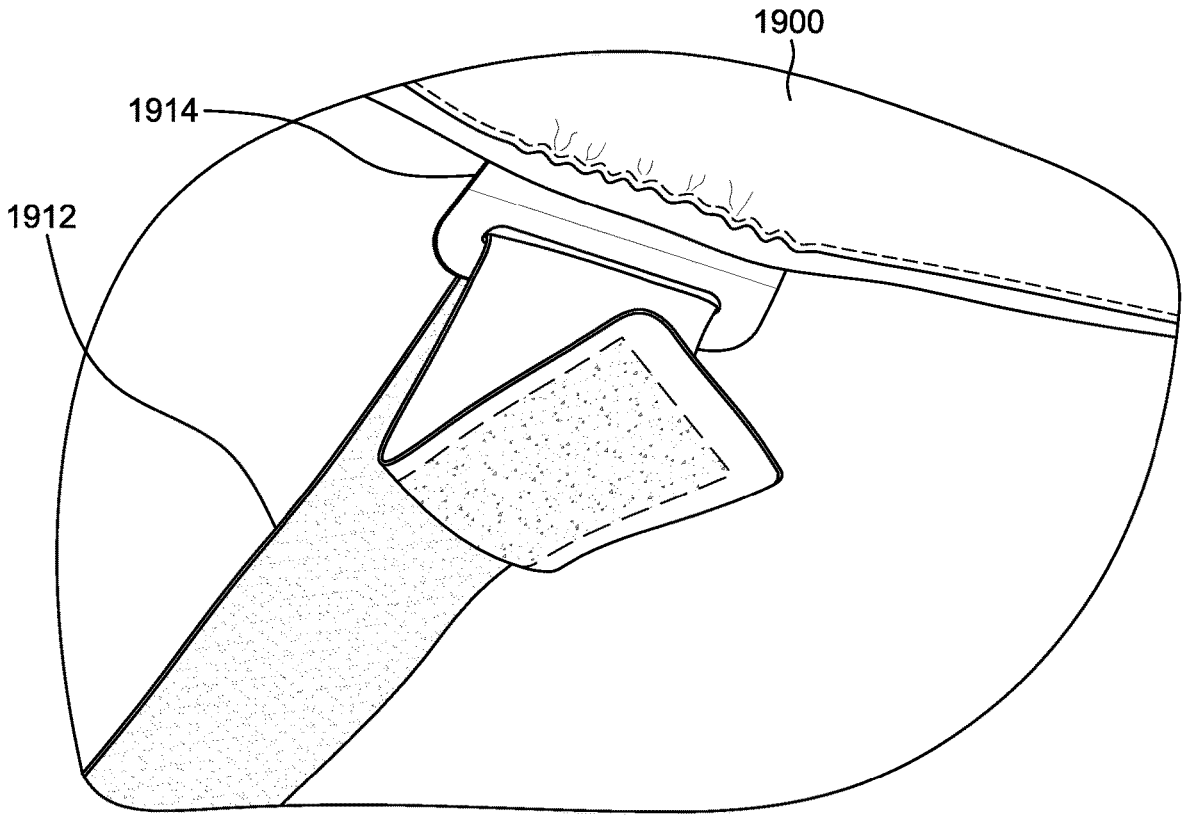

FIGS. 19A-19C illustrate another example embodiment of fasteners that may be used with a levitation system. As illustrated in FIG. 19A, fasteners 1902, 1904, 1906, and 1908 are coupled to or otherwise in operable communication with a cover 1900. Thus, the fasteners may be used to secure to a mattress or a box spring or a platform in order to prevent unintended movement. In some examples, the cover 1900 may also include an air inlet nozzle 1905, one or more adjustable openings 1903 and 1909, and an attachment point 1907. FIG. 19B illustrates that the fasteners (e.g., fasteners 1902, 1904, and 1906) may be secured to the cover 1900. In the illustrated embodiment, a fastener 1910 is sewn (illustrated at 1908) to cover 1900. FIG. 19C illustrates that the fasteners may be coupled to the cover 1900 using a loop or buckle 1914, which is secured to the cover 1900. In the illustrated embodiment, the buckle 1914 is sewn to cover 1900.

Figure 18:
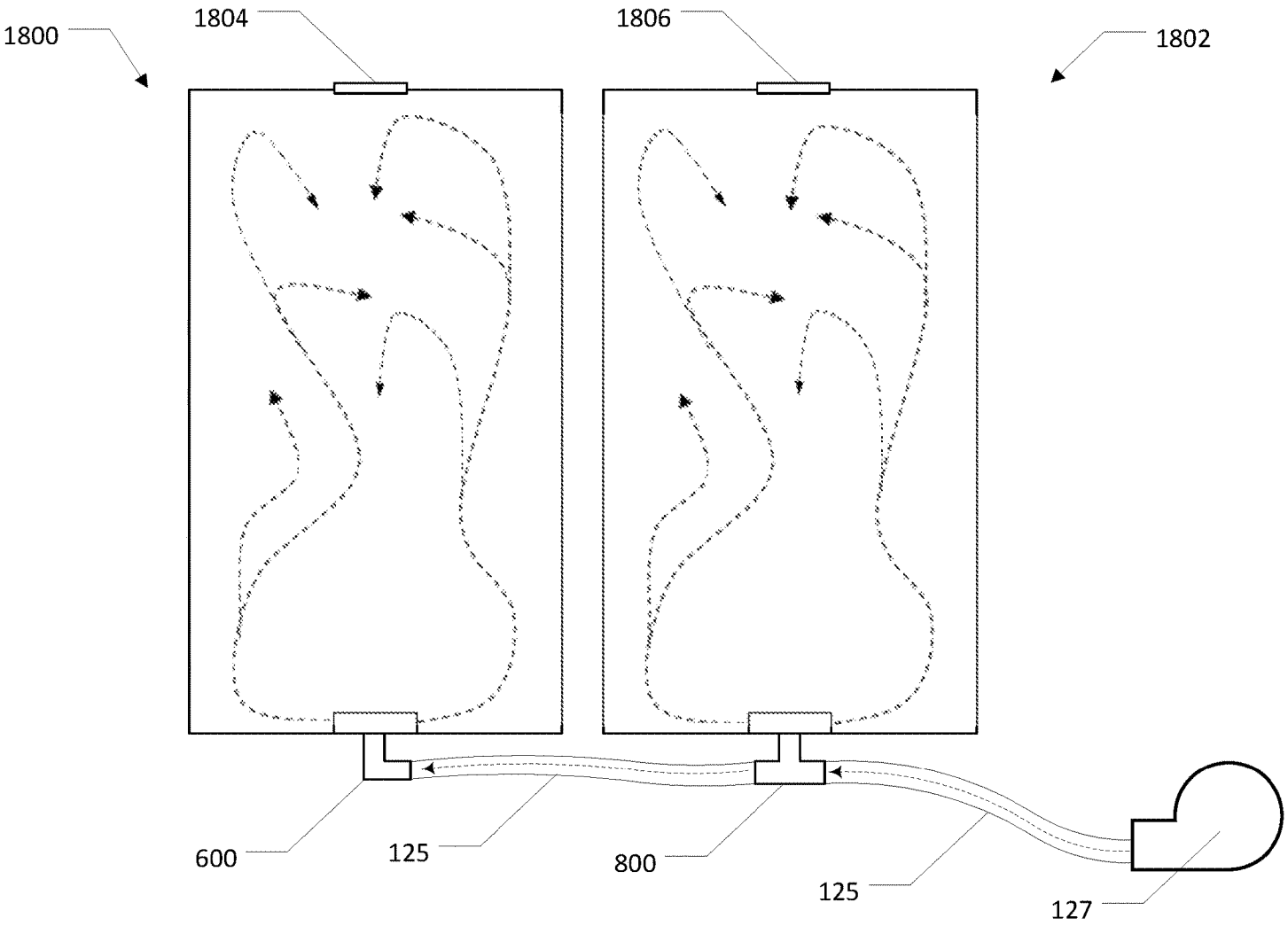
FIG. 18 illustrates a schematic of two levitation systems fluidly connected to one another and to an external air supply, wherein the first air inlet nozzle has an L-shaped configuration and the second air inlet nozzle has a dual-sided configuration.
Figure 20:
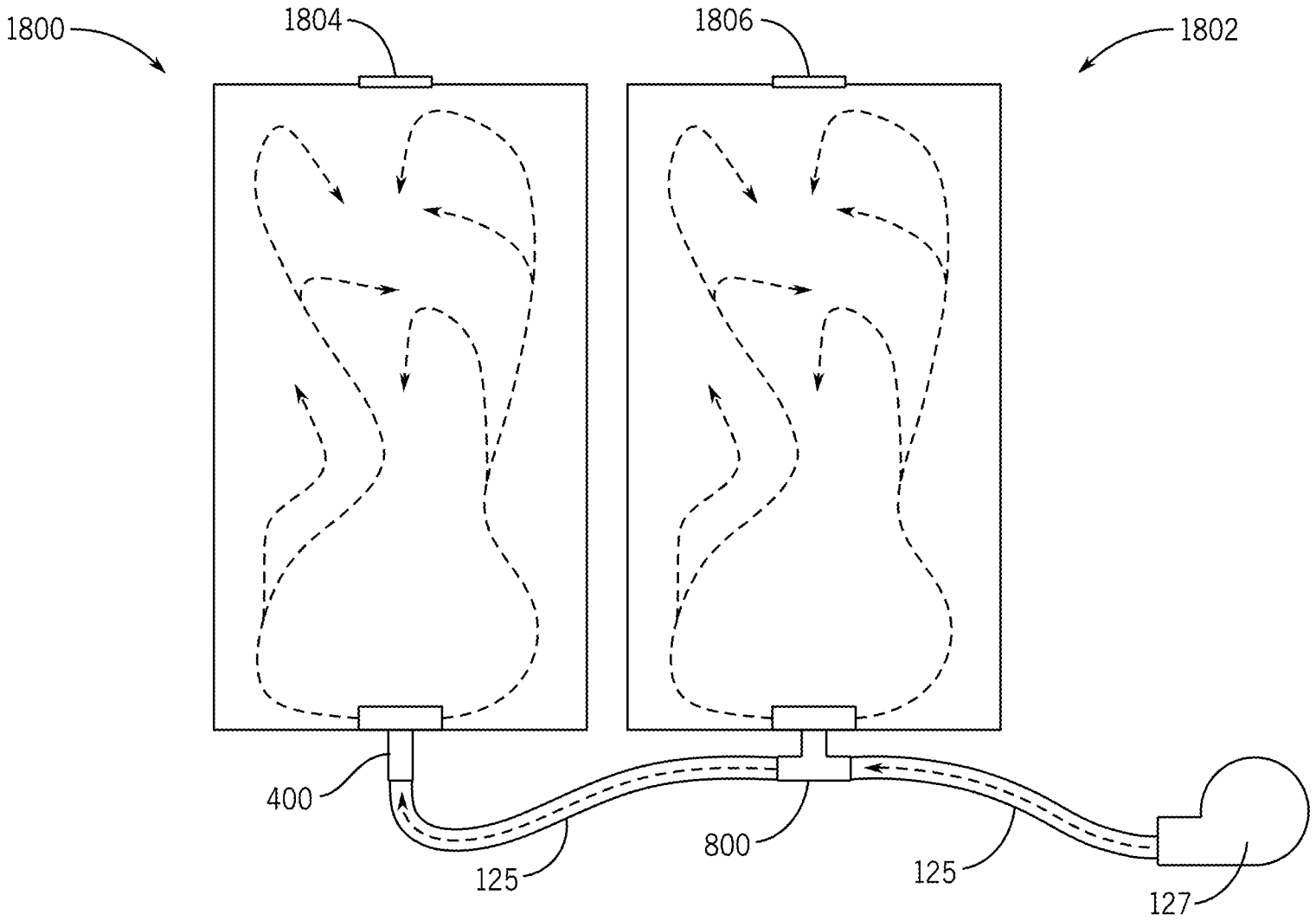
FIG. 20 illustrates a schematic of two levitation systems fluidly connected to one another and to an external air supply, wherein the first air inlet nozzle has a T-shaped configuration and the second air inlet nozzle has a dual-sided configuration.

In some examples of the present disclosure, more than one levitation system 120 may be used in conjunction with one another to facilitate the lifting or rotation of one or more mattresses. For example, the split-king bed arrangement includes two separate mattresses placed side by side on their own respective box springs or platforms, or on a single box spring or platform. As is illustrated in FIGS. 18 and 20, an example levitation system 1800 and an example levitation system 1802 may be fluidly connected to one another and to an external air pump 127. The example levitation system 1800 as shown in FIG. 18 includes an air inlet nozzle 600 with an L-shaped configuration and the example levitation system 1802 includes an air inlet nozzle 800 with a dual-sided configuration. In some example, as in the illustrated example, a portion of the air inlet nozzle 600 may be partially located internal to (i.e., operatively connected inside) the expandable volume, while other portions or components of the air inlet nozzle may be located external (i.e., operatively connected outside) to the expandable volume. The air supply end 814 of the air inlet nozzle 800 is directly connected to the external air pump 127, and the air supply connector end 816 of the air inlet nozzle 800 is directly connected to the air inlet nozzle 600. Alternatively, as shown in FIG. 20, the levitation system 1800 may include an air inlet nozzle 400 with a T-shaped configuration and the levitation system 1802 includes an air inlet nozzle 800 with a dual-sided configuration. Accordingly, with respect to FIGS. 18 and 20, the air from the external air pump 127 (indicated as the dotted arrows) flows into both the levitation system 1802 and the levitation system 1800 to raise the mattresses above the respective systems 1802 and 1800 on air cushions. In some instances, if too much or not enough air flow is reaching the levitation system 1800 and/or 1802, a person may adjust the adjustable openings 1804 and/or 1806 on the levitation systems 1800 and/or the levitation system 1802 to adjust the air flow reaching the levitation system 1800. In the illustrated example, the levitation system 1800 may include one or more adjustable openings 1804 and 1806, either of which are similar to adjustable openings 1300 (FIG. 13) and adjustable air openings 1903 and 1909 (FIG. 19A).

Without further elaboration, it is believed that one skilled in the art can use the preceding description to utilize the claimed inventions to their fullest extent. The examples and embodiments disclosed herein are to be construed as merely illustrative and not a limitation of the scope of the present disclosure in any way. It will be apparent to those having skill in the art that changes may be made to the details of the above-described embodiments without departing from the underlying principles discussed. In other words, various modifications and improvements of the embodiments specifically disclosed in the description above are within the scope of the appended claims. For example, any suitable combination of features of the various embodiments described is contemplated.

What is claimed is:

1. A system for facilitating lifting of two mattresses with respect to their respective box springs or platforms, the system comprising:

a first subsystem, wherein the first subsystem comprises:

a first layer of material;

a second layer of material attached to the first layer of material in a manner to form a first expandable air volume that is flat in a normal mode of operation and expanded in an expanded mode of operation, the first expandable air volume configured to be disposed between an underside of a first mattress and a top side of a first box spring or platform;

one or more first holes disposed in one of the first layer or the second layer for continuously releasing air from within the first expandable air volume;

wherein one or more of the first holes is a first adjustable opening disposed in one of the first layer or the second layer for controlling flow of air within the first expandable air volume; and a first air inlet nozzle in fluid communication with the first expandable air volume, wherein the first air inlet nozzle includes an interior portion disposed partially within the first expandable air volume such that the interior portion of the air inlet nozzle has an air inlet end outside the first expandable air volume and a first air outlet end within the first expandable air volume, and an exterior portion that couples to the interior portion with one of the first layer or the second layer disposed between the interior and exterior portions, and wherein the air inlet end is inserted through an opening in the exterior portion and the exterior portion slides onto the interior portion;

wherein the one or more first holes, the first adjustable opening, and the first air inlet nozzle are configured to regulate the air within the first expandable air volume under influence of an external air supply in fluid communication with the first air inlet nozzle, wherein the first expandable air volume lifts the first mattress with respect to the first box spring or platform; and a second subsystem, wherein the second subsystem comprises:

a third layer of material;

a fourth layer of material attached to the third layer of material in a manner to form a second expandable air volume that is flat in a normal mode of operation and expanded in an expanded mode of operation, the second expandable air volume configured to be disposed between an underside of a second mattress and a top side of a second box spring or platform;

one or more second holes disposed in one of the third layer or the fourth layer for continuously releasing air from within the second expandable air volume;

wherein the one or more second holes is a second adjustable opening disposed in one of the third layer or the fourth layer for controlling the flow of air within the second expandable air volume; and a second air inlet nozzle in fluid communication with the second expandable air volume, wherein the second air inlet nozzle includes an interior portion disposed partially within the second expandable air volume such that the interior portion of the air inlet nozzle has an air inlet end outside the second expandable air volume and a second air outlet end within the second expandable air volume, and an exterior portion that couples to the interior portion with one of the third layer or the fourth layer disposed between the interior and exterior portions, and wherein the air inlet end is inserted through an opening in the exterior portion and the exterior portion slides onto the interior portion;

wherein the one or more second holes, the second adjustable opening, and the second air inlet nozzle are configured to regulate the air within the second expandable air volume under the influence of an external air supply in fluid communication with the second air inlet nozzle, wherein the second expandable air volume lifts the second mattress with respect to the second box spring or platform, and wherein the first air inlet nozzle is in fluid communication with the second air inlet nozzle;

wherein the second air inlet nozzle has an L-shaped configuration and the first air inlet nozzle has a dual-sided configuration in which the exterior portion includes an air supply end and an air supply connector end, and air received through the supply end partially exits through the second air outlet end of the interior portion and partially exits through the air supply connector end.

2. A system for facilitating lifting of two mattresses with respect to their respective box springs or platforms, the system comprising:

a first subsystem, wherein the first subsystem comprises:

a first layer of material;

a second layer of material attached to the first layer of material in a manner to form a first expandable air volume that is flat in a normal mode of operation and expanded in an expanded mode of operation, the first expandable air volume configured to be disposed between an underside of a first mattress and a top side of a first box spring or platform;

one or more first holes disposed in one of the first layer or the second layer for continuously releasing air from within the first expandable air volume;

wherein one or more of the first holes is a first adjustable opening disposed in one of the first layer or the second layer for controlling flow of air within the first expandable air volume; and a first air inlet nozzle in fluid communication with the first expandable air volume, wherein the first air inlet nozzle includes an interior portion disposed partially within the first expandable air volume such that the interior portion of the air inlet nozzle has an air inlet end outside the first expandable air volume and a first air outlet end within the first expandable air volume, and an exterior portion that couples to the interior portion with one of the first layer or the second layer disposed between the interior and exterior portions, and wherein the air inlet end is inserted through an opening in the exterior portion and the exterior portion slides onto the interior portion;

wherein the one or more first holes, the first adjustable opening, and the first air inlet nozzle are configured to regulate the air within the first expandable air volume under influence of an external air supply in fluid communication with the first air inlet nozzle, wherein the first expandable air volume lifts the first mattress with respect to the first box spring or platform; and a second subsystem, wherein the second subsystem comprises:

a third layer of material;

a fourth layer of material attached to the third layer of material in a manner to form a second expandable air volume that is flat in a normal mode of operation and expanded in an expanded mode of operation, the second expandable air volume configured to be disposed between an underside of a second mattress and a top side of a second box spring or platform;

one or more second holes disposed in one of the third layer or the fourth layer for continuously releasing air from within the second expandable air volume;

wherein the one or more second holes is a second adjustable opening disposed in one of the third layer or the fourth layer for controlling the flow of air within the second expandable air volume; and a second air inlet nozzle in fluid communication with the second expandable air volume, wherein the second air inlet nozzle includes an interior portion disposed partially within the second expandable air volume such that the interior portion of the air inlet nozzle has an air inlet end outside the second expandable air volume and a second air outlet end within the second expandable air volume, and an exterior portion that couples to the interior portion with one of the third layer or the fourth layer disposed between the interior and exterior portions, and wherein the air inlet end is inserted through an opening in the exterior portion and the exterior portion slides onto the interior portion;

wherein the one or more second holes, the second adjustable opening, and the second air inlet nozzle are configured to regulate the air within the second expandable air volume under the influence of an external air supply in fluid communication with the second air inlet nozzle, wherein the second expandable air volume lifts the second mattress with respect to the second box spring or platform, and wherein the first air inlet nozzle is in fluid communication with the second air inlet nozzle;

wherein the first air inlet nozzle has a T-shaped configuration and the second air inlet nozzle has a dual-sided configuration in which the exterior portion includes an air supply end and an air supply connector end, and air received through the supply end partially exits through the second air outlet end of the interior portion and partially exits through the air supply connector end.

3. The system of claim 1, wherein at least one of the first adjustable opening and the second adjustable opening is a zippered opening.

4. The system of claim 1, wherein the exterior portion of the first air inlet nozzle couples to the interior portion of the first air inlet nozzle by a notch and a notch opening.

5. The system of claim 1, wherein the exterior portion of the second air inlet nozzle couples to the interior portion of the second air inlet nozzle by a notch and a notch opening.

6. The system of claim 1, wherein the first subsystem further includes a band attached to the first layer or the second layer, wherein the band removably secures the first subsystem to the underside of the first mattress or the top side of the first box spring.

7. The system of claim 1, wherein the second subsystem further includes a band attached to the first layer or the second layer, wherein the band removably secures the second subsystem to the underside of the second mattress or the top side of the second box spring.

8. The system of claim 1, wherein the first subsystem is integrally formed with a casing that is sized to fully encase one of the first mattress or the first box spring.

9. The system of claim 1, wherein the second subsystem is integrally formed with a casing that is sized to fully encase one of the second mattress or the second box spring.

10. The system of claim 1, wherein the first subsystem is integrally formed with one of the underside of the first mattress, the top side of the first box spring, or the top side of the first platform.

11. The system of claim 1, wherein the second subsystem is integrally formed with one of the underside of the second mattress, the top side of the second box spring, or the top side of the second platform.

12. The system of claim 2, wherein at least one of the first adjustable opening and the second adjustable opening is a zippered opening.

13. The system of claim 2, wherein the exterior portion of the first air inlet nozzle couples to the interior portion of the first air inlet nozzle by a notch and a notch opening.

14. The system of claim 2, wherein the exterior portion of the second air inlet nozzle couples to the interior portion of the second air inlet nozzle by a notch and a notch opening.

15. The system of claim 2, wherein the first subsystem further includes a band attached to the first layer or the second layer, wherein the band removably secures the first subsystem to the underside of the first mattress or the top side of the first box spring.

16. The system of claim 2, wherein the second subsystem further includes a band attached to the first layer or the second layer, wherein the band removably secures the second subsystem to the underside of the second mattress or the top side of the second box spring.

17. The system of claim 2, wherein the first subsystem is integrally formed with a casing that is sized to fully encase one of the first mattress or the first box spring.

18. The system of claim 2, wherein the second subsystem is integrally formed with a casing that is sized to fully encase one of the second mattress or the second box spring.

19. The system of claim 2, wherein the first subsystem is integrally formed with one of the underside of the first mattress, the top side of the first box spring, or the top side of the first platform.

20. The system of claim 2, wherein the second subsystem is integrally formed with one of the underside of the second mattress, the top side of the second box spring, or the top side of the second platform.

* * * * *